US005496681A

United States Patent [19]

Ezoe et al.

[11] Patent Number: 5,496,681

[45] Date of Patent: Mar. 5, 1996

[54] SILVER HALIDE PHOTOGRAPHIC MATERIAL AND PHOTOGRAPHIC IMAGE FORMATION METHOD USING THE SAME

[75] Inventors: Toshihide Ezoe; Tomokazu Yasuda, both of Kanagawa, Japan

[73] Assignee: Fuji Photo Film Co., Ltd., Kanagawa, Japan

[21] Appl. No.: 393,170

[22] Filed: Feb. 21, 1995

[30] Foreign Application Priority Data

Feb. 23, 1994 [JP] Japan ..... 6-047961

[51] Int. Cl.[6] ..... G03C 3/00

[52] U.S. Cl. ..... 430/264; 430/598; 430/600; 430/601

[58] Field of Search ..... 430/264, 601, 430/600, 598

[56] References Cited

U.S. PATENT DOCUMENTS

| | | | |
|---|---|---|---|
| 3,915,714 | 10/1975 | Saleck et al. | 430/601 |
| 4,324,856 | 4/1982 | Kawakatsu et al. | 430/601 |
| 4,326,022 | 4/1982 | Ito et al. | 430/601 |
| 4,910,126 | 3/1990 | Sato et al. | 430/601 |
| 4,950,578 | 8/1990 | Yagihara et al. | 430/264 |
| 4,994,364 | 2/1991 | Inoue et al. | 430/598 |
| 5,279,919 | 1/1994 | Okamura et al. | 430/264 |
| 5,284,732 | 2/1994 | Nii et al. | 430/264 |

FOREIGN PATENT DOCUMENTS

| | | | |
|---|---|---|---|
| 0088283 | 4/1993 | Japan | 430/601 |

OTHER PUBLICATIONS

Research Disclosure, Item 308119, III, p. 996, Dec. 1989, Anonomous, Kenneth Mason Publications, Ltd.

*Primary Examiner*—Hoa Van Le

*Attorney, Agent, or Firm*—Sughrue, Mion, Zinn, Macpeak & Seas

[57] ABSTRACT

A silver halide photographic material is described, which comprises a hydrazine derivative represented by the following formula (I) and a surface active compound represented by the following formula (II):

$$R_1-\underset{\underset{A_1}{|}}{N}-\underset{\underset{A_2}{|}}{N}-G_1-R_2 \qquad (I)$$

and wherein the substituents are defined in the specification. An image formation method using the silver halide photographic material is also described.

8 Claims, No Drawings

SILVER HALIDE PHOTOGRAPHIC MATERIAL AND PHOTOGRAPHIC IMAGE FORMATION METHOD USING THE SAME

FIELD OF THE INVENTION

The present invention relates to a silver halide photographic material and, more particularly, to a very high contrast silver halide photographic material used for photomechanical processes.

BACKGROUND OF THE INVENTION

In the field of graphic arts, image forming systems which can ensure very high contrast photographic characteristics (especially a gamma value (γ) of at least 10) are required for satisfactory reproduction of continuous tone images or line originals in halftone images.

As an image forming system which can provide very high contrast photographic characteristics in the development with a processing solution having sufficient storage stability, the image forming systems in which a surface latent image type silver halide photographic material containing a specified acylhydrazine compound as a nucleating agent is developed with a processing solution which contains 0.15 mol/l or more of a sulfite preservative and is adjusted to pH 11.0–12.3 to form a very high contrast negative image having γ of 10 or more have been proposed, such as disclosed in U.S. Pat. Nos. 4,166,742, 4,168,977, 4,221,857, 4,224,401, 4,243,739, 4,272,606 and 4,311,781.

In recent years, various ways to enable hydrazine compounds to produce their sensitizing and contrast-increasing effects by using a developer having a low pH value to stand long-range storage and long use have been proposed. For instance, the methods disclosed in JP-A-1-179939 and JP-A-1- 179940 (the term "JP-A" as used herein means an "unexamined published Japanese patent application") comprise using a photosensitive material which contains both a nucleation development accelerator having an adsorption group to silver halide emulsion grains and a nucleating agent having the similar adsorption group, and processing the photosensitive material with a developer adjusted to a pH value lower than 11.0, thereby forming very high contrast images. On the other hand, the use of highly active hydrazine compounds as a nucleating agent is disclosed in U.S. Pat. Nos. 4,998,604, 4,994,365 and 4,975,354, JP-A-3-259240 and JP-A-5-45761.

On the other hand, in preparing a silver halide photographic material, it frequently happens that a coating solution containing an emulsion and all the ingredients to be admixed therewith in a dissolved condition is allowed to stand for several hours prior to the application to a support. Under such a situation, the photographic material encounters a problem such that the highly active nucleating agent contained therein causes a considerable increase in intrinsic sensitivity of the emulsion or decomposes to such an extent as to exert bad influence upon photographic properties.

Thus, the technique of using highly active hydrazine compounds as a stable nucleating agent without spoiling their nucleation activity is still incomplete, and it has been expected to make improvements therein.

SUMMARY OF THE INVENTION

Therefore, an object of the present invention is to provide a silver halide photographic material which contains a highly active hydrazine compound as a stable dispersion so that the compound may fully achieve its nucleation effect.

This and other objects of the present invention have been attained with a silver halide photographic material comprising a hydrazine derivative represented by the following formula (I) and a surface active compound represented by the following formula (II):

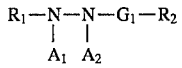

(I)

wherein $R_1$ represents an aliphatic group or an aromatic group, which each may be substituted by at least one substituent; $R_2$ represents a hydrogen atom, an alkyl group, an aryl group, an unsaturated heterocyclic group, an alkoxy group, an aryloxy group, an amino group or a hydrazino group, which each may be substituted by at least one substituent; $G_1$ represents —CO—, —$SO_2$—, —SO—, —PO($R_3$)—, —CO—CO—, a thiocarbonyl group or an iminomethylene group; $A_1$ and $A_2$ are both a hydrogen atom, or one of them is a hydrogen atom and the other is a substituted or unsubstituted alkylsulfonyl group, a substituted or unsubstituted arylsulfonyl group, or a substituted or unsubstituted acyl group; $R_3$ has the same meaning as $R_2$, but it may be different from $R_2$:

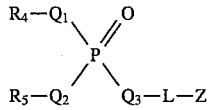

(II)

wherein $R_4$ represents an aliphatic group, an alicyclic group, an aromatic group or a heterocyclic group, which may be substituted by at least one substituent; $R_5$ represents an aliphatic group, an alicyclic group, an aromatic group, a heterocyclic group or a group represented by —L—Z in which L represent a divalent linkage group; and Z represents an ionic group; and $Q_1$, $Q_2$ and $Q_3$ each represents a single bond, an oxygen atom, a sulfur atom or a group represented by —N($R_6$)— or —N($R_6$)—CO—, in which $R_6$ represents a hydrogen atom or has the same meaning as $R_5$, but it may be different from $R_5$.

Further, this and other objects of the present invention have been attained with a photographic image formation method, which comprises the step of imagewise exposing the above-described photographic material and developing the exposed material with a developer having a pH of from 9.0 to less than 11.0.

DETAILED DESCRIPTION OF THE INVENTION

In formula (I), the aliphatic group represented by $R_1$ is preferably an aliphatic group having from 1 to 30 carbon atoms. In particular, a straight-chain, branched or cyclic alkyl group having from 1 to 20 carbon atoms is preferred as $R_1$. The branched alkyl group may form a saturated heterocyclic ring containing at least one hetero atom in the alkyl group. The alkyl group may have at least one substituent described below.

The aromatic group represented by $R_1$ in formula (I) is a monocyclic or dicyclic aryl group or an unsaturated heterocyclic group. The unsaturated heterocyclic group may form a heteroaryl group by fusing a monocyclic or dicyclic aryl groups. Examples of the ring formed by $R_1$ include a benzene ring, a naphthalene ring, a pyridine ring, a pyrimidine ring, an imidazole ring, a pyrazole ring, a quinoline ring, an isoquinoline ring, a benzimidazole ring, a thiazole ring and a benzothiazole ring. Among these, the group containing a benzene ring is preferred.

$R_1$ is more preferably an aryl group.

The aliphatic and aromatic groups represented by $R_1$ may have at least one substituent. Typical examples of such substituent include an alkyl group, an alkenyl group, an alkynyl group, an aryl group, a heterocyclic group (a group containing a heterocyclic ring), a pyridinium group, a hydroxyl group, an alkoxy group, an aryloxy group, an acyloxy group, an alkylsulfonyloxy group, an arylsulfonyloxy group, an amino group, a carbonamido group (e.g., a group containing —C(=O)—N<), a sulfonamido group (e.g., a group containing —$SO_2$—N<), a ureido group, a thioureido group, a semicarbazido group, a thiosemicarbazido group, a urethane group (e.g., a group containing >N—C(=O)O—), a group having a hydrazide structure, a group having a quaternary ammonium structure, an alkylthio group, an arylthio group, an alkylsulfonyl group, an arylsulfonyl group, an alkylsulfinyl group, an arylsulfinyl group, a carboxyl group (e.g., a group containing —$COO^-$), a sulfo group, an acyl group, an alkoxycarbonyl group, an aryloxycarbonyl group, a carbamoyl group, a sulfamoyl group, a halogen atom, a cyano group, a phosphonamido group (e.g., a group containing >P(=O)—N<), a diacylamino group, an imido group, a group having an acylurea structure, a group containing a selenium atom or a tellurium atom, and a group having a tertiary sulfonium structure or a quaternary sulfonium structure. Of these, preferred are a strain-chain, branched or cyclic alkyl group (preferably one having from 1 to 20 carbon atoms), an aralkyl group (preferably monocyclic or dicyclic one having an alkyl moiety of from 1 to 3 carbon atoms), an alkoxy group (preferably one having from 1 to 20 carbon atoms), a substituted amino group (preferably an amino group substituted with at least one alkyl group having from 1 to 20 carbon atoms), an acylamino group (preferably one having from 2 to 30 carbon atoms), a sulfonamido group (preferably one having from 1 to 30 carbon atoms), a ureido group (preferably one having from 1 to 30 carbon atoms) and a phosphonamido group (preferably one having from 1 to 30 carbon atoms). The above-described substituents may be further substituted by one or more of these substituents.

In formula (I), the alkyl group represented by $R_2$ is preferably an alkyl group having from 1 to 4 carbon atoms, and the aryl group represented by $R_2$ is preferably a monocyclic or dicyclic aryl group such as an aryl group containing a benzene ring.

The unsaturated heterocyclic group represented by $R_2$ is preferably a compound having a 5- or 6-membered ring containing at least one nitrogen, oxygen or sulfur atom. Examples thereof are an imidazolyl group, a pyrazolyl group, a triazolyl group, a tetrazolyl group, a pyridyl group, a pyridinium group, a quinolinium group and a quinolinyl group. Among these, more preferred are a pyridyl group and a pyridinium group.

The alkoxy group represented by $R_2$ is preferably an alkoxy group having from 1 to 8 carbon atoms.

The aryloxy group represented by $R_2$ is preferably a monocyclic aryloxy group.

The amino group represented by $R_2$ is preferably an unsubstituted amino group or an alkylamino or arylamino group having from 1 to 10 carbon atoms.

$R_2$ may be substituted by at least one substituent, and examples of such substituent include those recited above with respect to $R_1$.

When $G_1$ represents —CO—, $R_2$ is preferably a hydrogen atom, an alkyl group (e.g., methyl, trifluoromethyl, 3-hydroxypropyl, 3-methanesulfonamidopropyl, phenylsulfonylmethyl), an aralkyl group (e.g., o-hydroxybenzyl) or an aryl group (e.g., phenyl, 3,5-dichlorophenyl, o-methanesulfonamidophenyl, 4-methanesulfonylphenyl, 2-hydroxymethylphenyl), and more preferably a hydrogen atom or a trifluoromethyl group.

When $G_1$ represents —$SO_2$—, $R_2$ is preferably an alkyl group (e.g., methyl), an aralkyl group (e.g., o-hydroxybenzyl group), an aryl group (e.g., phenyl) or a substituted amino group (e.g., dimethylamino).

When $G_1$ represents —CO—CO—, $R_2$ is preferably an alkoxy group, an aryloxy group or an amino group.

In formula (I), $G_1$ is preferably —CO— or —CO—CO—, and more preferably —CO—.

Further, $R_2$ may be a group such that it can split the $G_1$—$R_2$ moiety off the residual molecule and thereby cause the cyclization reaction to form a cyclic structure containing the atoms of the $G_1$—$R_2$ moiety. Specific examples of such a group include those disclosed in JP-A-63-29751.

$A_1$ and $A_2$ is preferably a hydrogen atom, an alkylsulfonyl or arylsulfonyl group having from 1 to 20 carbon atoms (more preferably, a phenylsulfonyl group or a phenylsulfonyl group substituted by at least one substituent having total Hammett's reaction constant of −0.5 or more) or an acyl group having from 1 to 20 carbon atoms (more preferably, a benzoly group, a benzoyl group substituted by at least one substituent having total Hammett's reaction constant of −0.5 or more, or a straight-chain, branched or cyclic acyl group, which may be substituted by at least one substituent such as a halogen atom, an ether group, a sulfonamido group, a carbonamido group, a hydroxyl group, a carboxyl group or a sulfonic acid group). Examples of the substituted alkylsulfonyl or arylsulfonyl group include a p-methylphenylsulfonyl group, a pentafluorophenylsulfonyl group, a p-ethoxycarbonylphenylsulfonyl group, a m-methoxyphenylsulfonyl group and a p-cyanophenylsulfonyl group. Examples of the substituted benzoyl group include a p-methylbenzoyl group, a pentafluorobenzoyl group, a p-ethoxycarbonylbenzoyl group, a m-methoxybenzoyl group and a p-cyanobenzoyl group.

More preferably, $A_1$ and $A_2$ are each a hydrogen atom.

The substituents of $R_1$ and $R_2$ may be further substituted by at least one substituent, and examples of such substituent include those recited above with respect to $R_1$. The substituted substituents may be further substituted by a substituent, a substituted substituent, a ((substituted substituent)-substituted substituent, and so on, and the examples of the substituents also include those recited above with respect to $R_1$.

Moreover, $R_1$ or $R_2$ in formula (I) may be a group into which a ballast group used commonly in immobile photographic additives, such as couplers, or a polymeric moiety is introduced. The ballast group is a group containing 8 or more carbon atoms and having a relatively slight influence upon photographic properties, and examples thereof include an alkyl group, an alkoxy group, a phenyl group, an alkylphenyl group, a phenoxy group, and an alkylphenoxy group. Examples of the polymeric moiety include those described in JP-A-1-100530.

Further, $R_1$ or $R_2$ in formula (I) may be a group into which a group capable of intensifying the adsorption onto the grain surface of silver halide is introduced. Examples of the adsorption-intensifying group include thiourea groups, heterocyclic thioamido groups, mercapto heterocyclic groups and triazole groups, such as described in U.S. Pat. Nos. 4,385,108 and 4,459,347, JP-A-59-195233, JP-A-59-200231, JP-A-59-201045, JP-A-59-201046,JP-A-59-

201047, JP-A-59-201048, JP-A-59-201049, JP-A-61-170733, JP-A-61-270744, JP-A-62-948, JP-A-63-234244, JP-A-63-234245 and JP-A-63-234246.

The particularly preferred hydrazine compound in the present invention is a hydrazine compound represented by formula (I), wherein $R_1$ a group capable of accelerating the adsorption onto the ballast group or the surface of silver halide grains, a group having a quaternary ammonium structure or an alkylthio group; $G_1$ is —CO—, $R_2$ is a hydrogen atom or a substituted alkyl or substituted aryl group (as such substituent, an electron attracting group and a hydroxymethyl group to the 2-position thereof are preferred). All the combinations of the above-described $R_1$ and $R_2$ can be selected and are preferred.

Specific examples of the compound represented by formula (I) are illustrated below. However, the invention should not be construed as being limited to these examples.

I-1

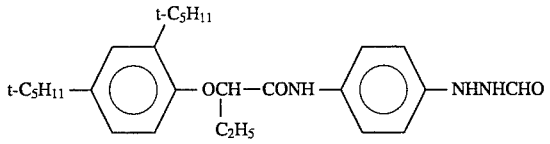

I-2

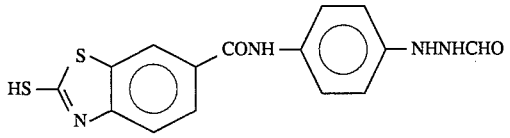

I-3

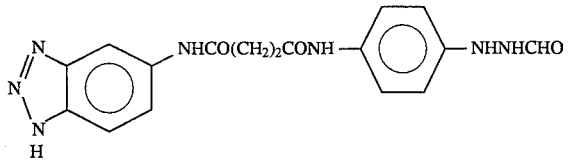

I-4

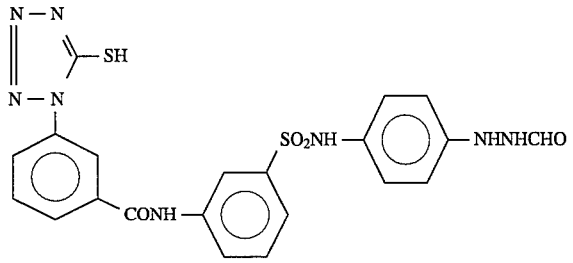

I-5

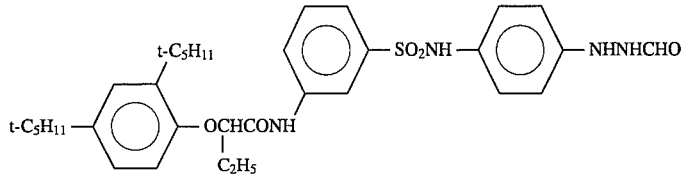

I-6

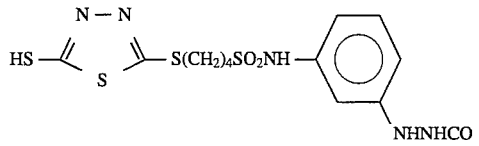

I-7

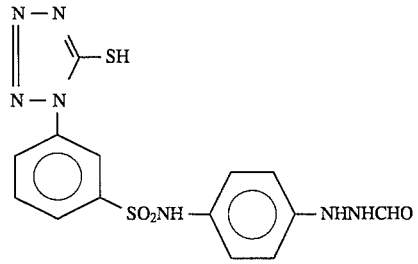

-continued
I-8
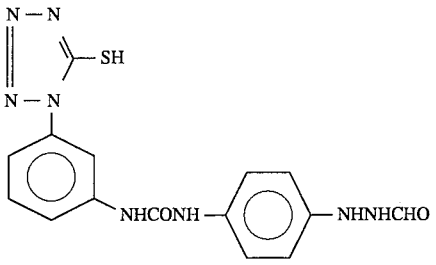
I-9
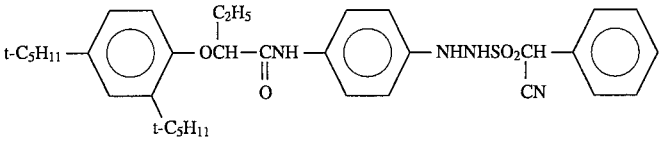
I-10
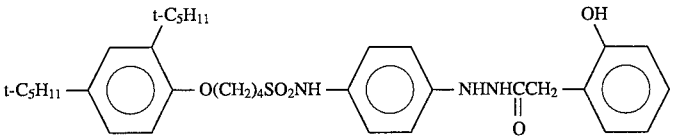
I-11
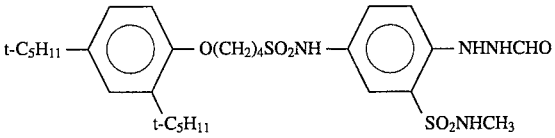
I-12
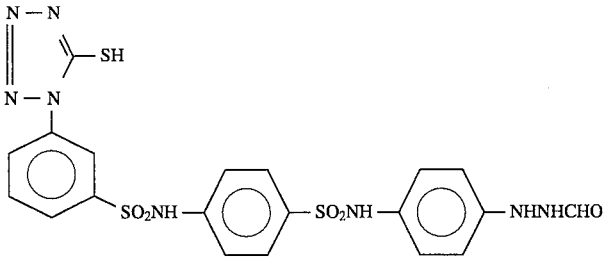
I-13
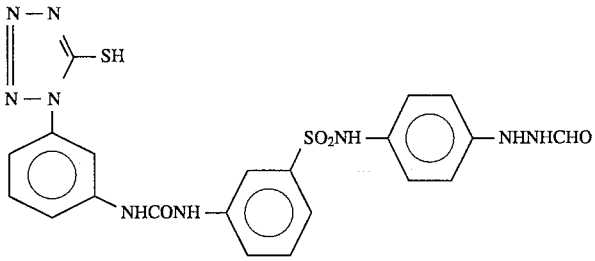
I-14
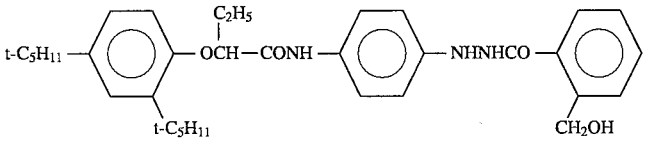
I-15
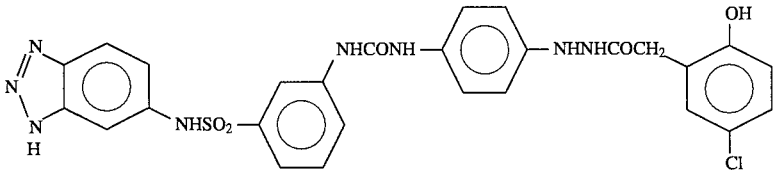
I-16
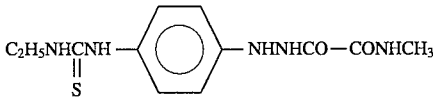

-continued
I-17
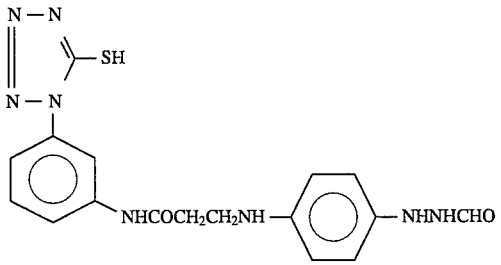
I-18
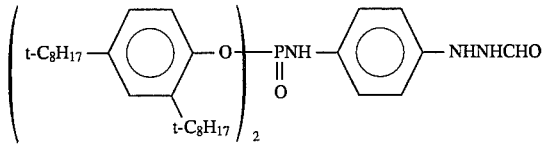
I-19
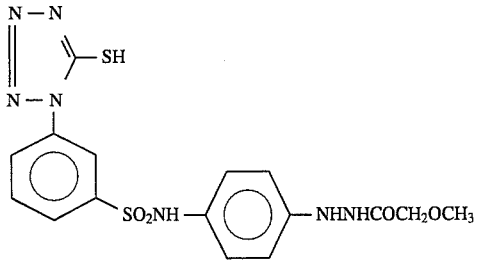
I-20
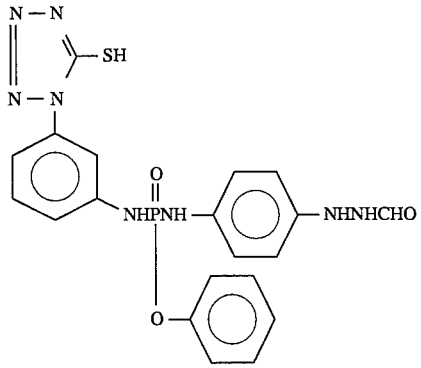
I-21
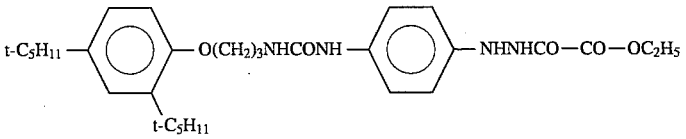
I-22
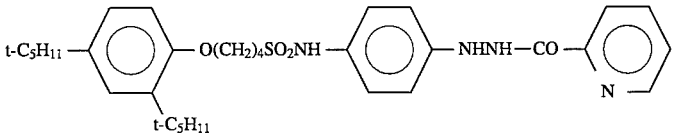
I-23
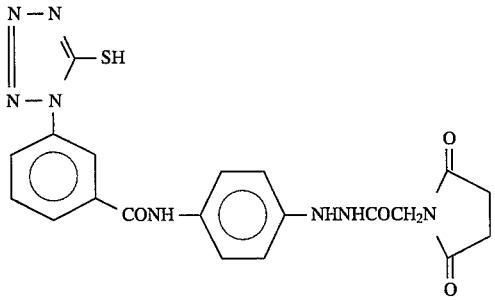

-continued
I-24
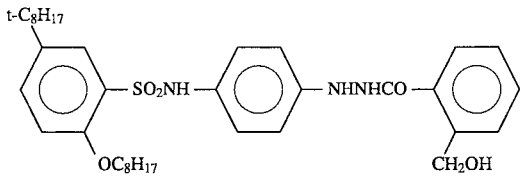
I-25
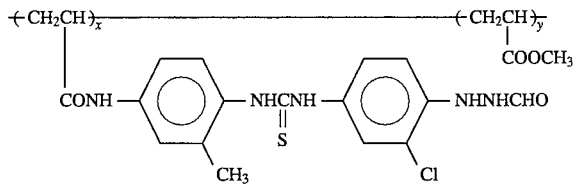
x:y = 3:97
Average molecular weight: about 100,000
I-26
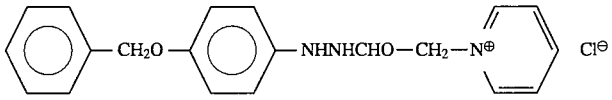
I-27
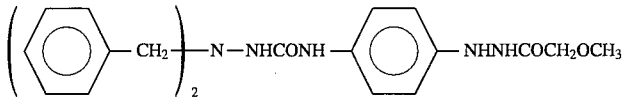
I-28
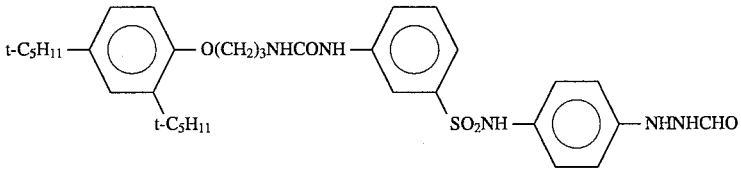
I-29
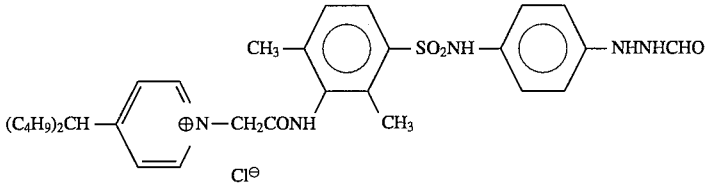
I-30
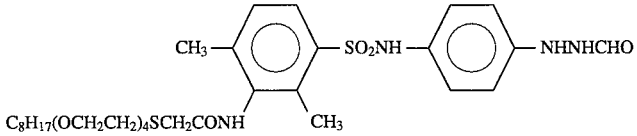
I-31
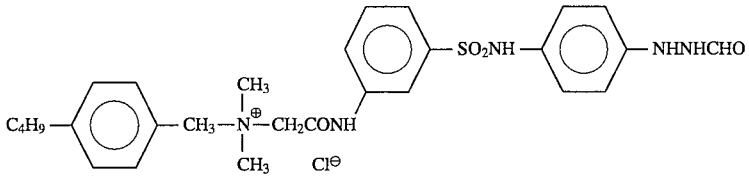
I-32
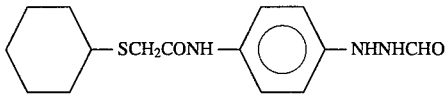
I-33
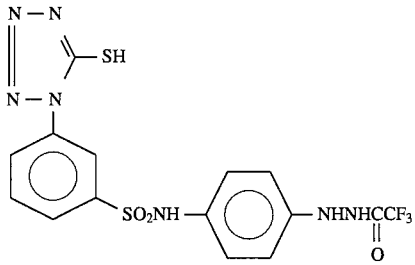

-continued
I-34
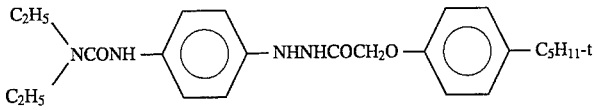
I-35
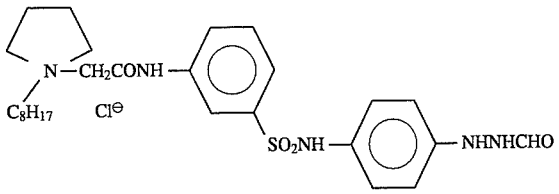
I-36
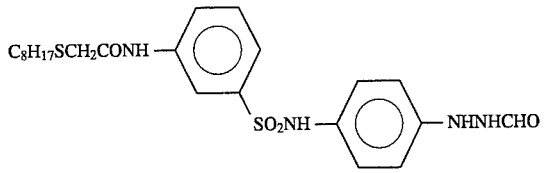
I-37
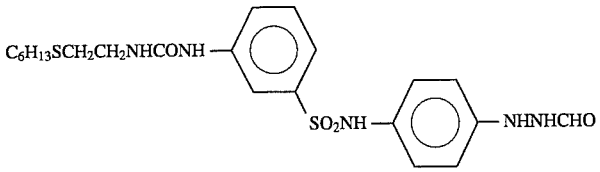
I-38
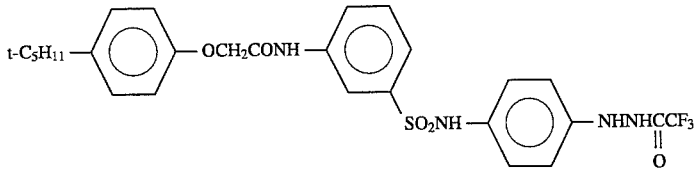
I-39
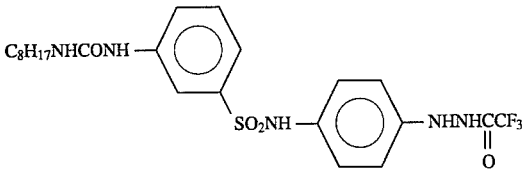
I-40
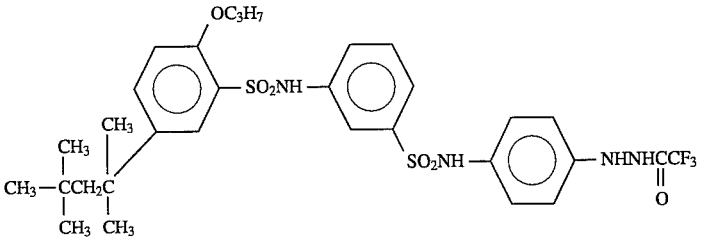
I-41
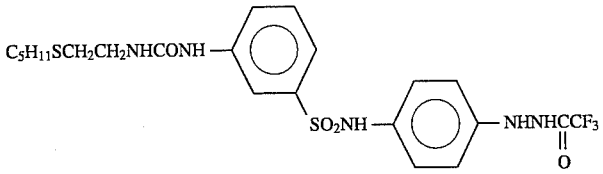

-continued
I-42
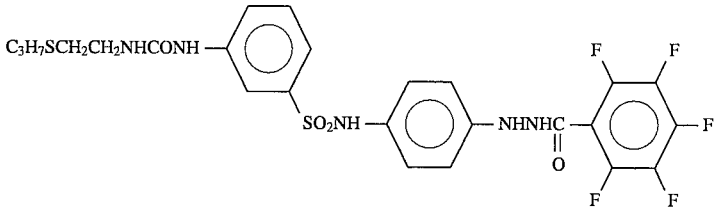
I-43
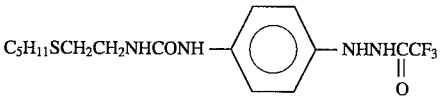
I-44
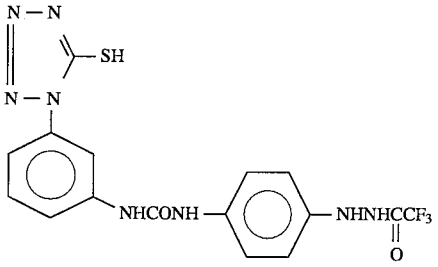
I-45
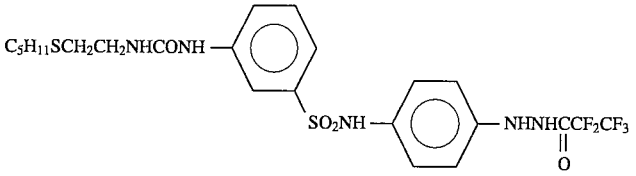
I-46
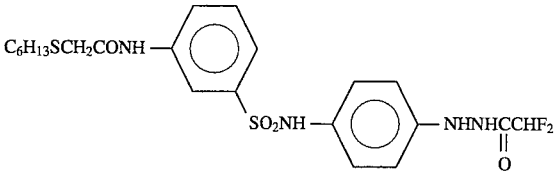
I-47
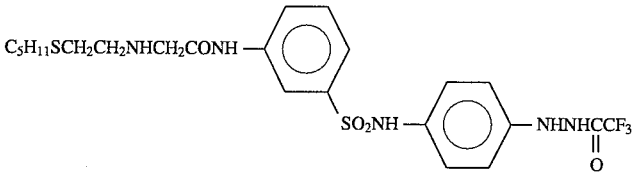
I-48
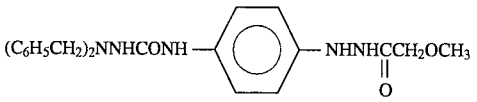
I-49
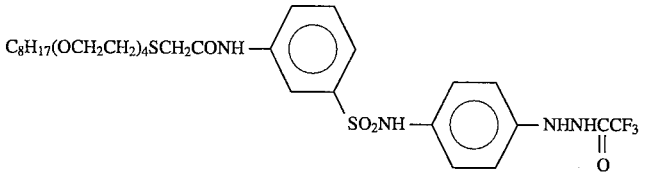
I-50
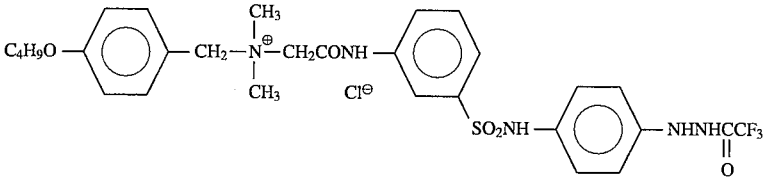

-continued

I-51

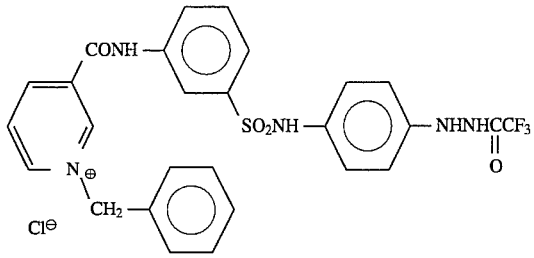

I-52

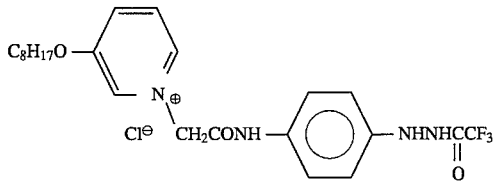

I-53

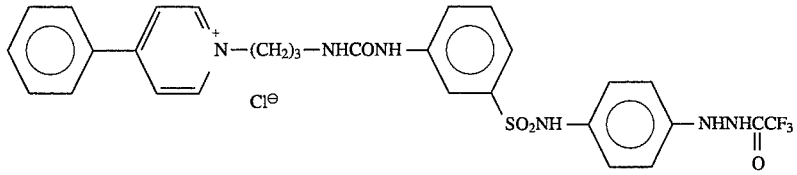

In addition to the above-illustrated ones, hydrazine derivatives which can be used in the present invention include those disclosed in *Research Disclosure,* Item 23516, page 346 (November, 1983), the references cited in *ibid.,* U.S. Pat. Nos. 4,080,207, 4,269,929, 4,276,364, 4,278,748, 4,385,108, 4,459,347, 4,478,928, 4,560,638, 4,686,167, 4,912,016, 4,988,604, 4,994,365, 5,041,355 and 5,104,769, British Patent No. 2,011,391B, European Patent Nos. 217, 310, 301,799 and 356,898, JP-A-60-179734, JP-A-61-170733, JP-A-61-270744, JP-A-62-178246, JP-A-63-32538, JP-A-63-104047, JP-A-63-121838, JP-A-63-129337,JP-A-63-223744, JP-A-63-234244,JP-A-63-234245, JP-A-63-234246, JP-A-63-294552, JP-A-63-306438, JP-A-64-10233, JP-A-1-90439, JP-A-1-100530, JP-A-1-105941, JP-A-1-105943, JP-A-1-276128, JP-A-1-280747, JP-A-1-283548, JP-A-1-283549, JP-A-1-285940, JP-A-2-2541, JP-A-2-77057, JP-A-2-139538, JP-A-2-196234, JP-A-2-196235, JP-A-2-198440, JP-A-2-198441, JP-A-2-198442, JP-A-2-220042, JP-A-2-221953, JP-A-2-221954, JP-A-2-285342, JP-A-2-285343, JP-A-2-289843, JP-A-2-302750, JP-A-2-304550, JP-A-3-37642, JP-A-3-54549, JP-A-3-125134, JP-A-3-184039, JP-A-3-240036, JP-A-3-240037, JP-A-3-259240, JP-A-3-280038, JP-A-3-282536, JP-A-4-51143, JP-A-4-56842, JP-A-4-84134, JP-A-2-230233, JP-A-4-96053, JP-A-4-216544, JP-A-5-45761, JP-A-5-45762, JP-A-5-45763, JP-A-5-45764 and JP-A-5-45765, JP-A-6-289524 and EP-A-618486.

The hydrazine derivative of the present invention is preferably added in an amount of from $1\times10^{-6}$ to $5\times10^{-2}$ mol, more preferably from $1\times10^{-5}$ to $2\times10^{-2}$ mol, per mol of silver halide.

In using the hydrazine derivative in the present invention, it may be dissolved in a proper water-miscible organic solvent, such as alcohols (e.g., methanol, ethanol, propanol, fluorinated alcohols), ketones (e.g., acetone, methyl ethyl ketone), dimethylformamide, dimethylsulfoxide and methyl cellosolve.

Further, the hydrazine derivative can be used in the form of emulsified dispersion, which is prepared using the well-known emulsion dispersion method in which the hydrazine derivative is dissolved using an oil such as dibutyl phthalate, tricresyl phosphate, glyceryl triacetate and diethyl phthalate, together with an auxiliary solvent, such as ethyl acetate and cyclohexanone, and then dispersed mechanically in an emulsified condition. On the other hand, the so-called solid dispersion method can be adopted in using the hydrazine derivative, wherein the powdered hydrazine derivative is dispersed into water by means of a ball mill, a colloid mill or ultrasonic waves.

The hydrazine derivative may be contained in fine polymer particles as described in JP-A-2-948.

Suitable examples of the aliphatic group represented by $R_4$ or $R_5$ in formula (II) include a straight-chain or branched unsubstituted alkyl group having from 1 to 40 carbon atoms and no substituent group (e.g., methyl, ethyl, n-propyl, isopropyl, n-butyl, sec-butyl, tert-butyl, n-amyl, tert-amyl, n-hexyl, n-heptyl, n-octyl, tert-octyl, 2-ethylhexyl, n-nonyl, 1,1,3-trimethylhexyl, n-decyl, n-dodecyl, cetyl, hexadecyl, 2-hexyldecyl, octadecyl, eicosyl, 2-octyldodecyl, docosyl, tetracosyl, 2-decyltetradecyl, tricosyl), a straight-chain or branched alkyl group having from 1 to 40 carbon atoms substituted by at least one substituent such as an alkoxy group, an aryl group, a halogen atom, a carbon ester group (e.g., a group containing —C(=O)—O—), a carbonamido group (e.g., a group containing —C(=O)—N<), a carbamoyl group, an oxycarbonyl group, a phosphoric acid ester group (e.g., a group containing >P(=O)—O—), an alkyl group, an alkenyl group or an alkynyl group, which each may be further substituted by one or more of these substituents (e.g., benzyl, β-phenetyl, 2-methoxyethyl, 4-phenylbutyl, 4-acetoxyethyl, 6-phenoxyhexyl, 12-phenyldodecyl, 18-phenyloctadecyl, heptadecylfluorooctyl, 12-(p-chlorophenyl)dodecyl, 2-(diphenylphosphato)ethyl), a straight-chain or branched unsubstituted alkenyl group having from 2 to 40 carbon atoms (e.g., vinyl, allyl, 3-butenyl, 2-methyl-2-butenyl, 4-pentenyl, 3-pentenyl, 3-methyl-3-pentenyl, 5-hexenyl, 4-hexenyl, 3-hexenyl, 2-hexenyl, 7-octenyl, 9-decenyl, oleyl, linoleyl, linolenyl), a straight-chain or branched alkenyl group having from 2 to 40 carbon atoms substituted by at least one substituent such as those recited above with regard to the substituted alkyl group of $R_4$ or $R_5$ (e.g., 2-phenylvinyl, 4-acetyl-2-butenyl, 13-methoxy-9-octadecenyl, 9,10-dibromo-12-octadecenyl), a straight-chain or branched unsubstituted alkynyl group having from 2 to 40 carbon atoms (e.g., acetylene, propargyl, 3-butinyl, 4-pentinyl, 4-hexinyl, 4-hexinyl, 3-hexinyl, 2-hexinyl) and a straight-chain or branched alkynyl group having from 2 to 40 carbon atoms substituted by at least one substituent such as those recited above with regard to the substituted alkyl group of $R_4$ or $R_5$ (e.g., 2-phenylacetylene, 3-phenylpropargyl).

Suitable examples of the alicyclic group represented by $R_4$ or $R_5$ include a cycloalkyl group having from 3 to 40 carbon atoms, which may be substituted by at least one substituent such as those recited above with regard to the substituted alkyl group of $R_4$ or $R_5$ (e.g., cyclopropyl, cyclohexyl, 2,6-dimethylcyclohexyl, 4-tert-butylcyclohexyl, 4-phenylcyclohexyl, 3-methoxycyclohexyl, cycloheptyl) and a cycloalkenyl group having from 4 to 40 carbon atoms, which may be substituted by at least one substituent such as those recited above with regard to the substituted alkyl group of $R_4$ or $R_5$ (e.g., 1-cyclohexenyl, 2-cyclohexenyl, 3-cyclohexenyl, 2,6-dimethyl-3-cyclohexenyl, 4-tert-butyl-2-cyclohexenyl, 2-cycloheptenyl, 3-methyl- 3-cycloheptenyl).

Suitable examples of the aromatic group represented by $R_4$ or $R_5$ include an aryl group having from 6 to 50 carbon atoms, which may be substituted by at least one substituent such as those recited above with regard to the substituted alkyl group of $R_4$ or $R_5$ (e.g., phenyl, 1-naphthyl, 2-naphthyl, anthranyl, o-cresyl, m-cresyl, p-cresyl, p-ethylphenyl, p-tert-butylphenyl, 3,5-di-tert-butylphenyl, p-n-amylphenyl, p-tert-amylphenyl, 2,6-dimethyl-4-tert-butylphenyl, p-cyclohexylphenyl, octylphenyl, p-tert-octylphenyl, nonylphenyl, p-n-dodecylphenyl, m-methoxyphenyl, p-butoxyphenyl, m-octyloxyphenyl, biphenyl, m-chlorophenyl, pentachlorophenyl, 2-( 5-methylnaphthyl)).

Suitable examples of the heterocyclic group represented by $R_4$ or $R_5$ include a cyclic ether group having from 4 to 40 carbon atoms, which may be substituted by at least one substituent such as those recited above with regard to the substituted alkyl group of $R_4$ or $R_5$ (e.g., furyl, 4-butyl-3-furyl, pyranyl, 5-octyl-2H-pyran-3-yl, isobenzofuranyl, chromenyl) and a nitrogen-containing heterocyclic group, which may be substituted by at least one substituent such as those recited above with regard to the substituted alkyl group of $R_4$ or $R_5$ (e.g., 2H-pyrrolyl, pyrrolyl, imidazolyl, pyrazolyl, indolizinyl, morpholyl).

Of the groups recited above, those preferred in particular are a straight-chain, cyclic or branched unsubstituted alkyl group having from 1 to 24 carbon atoms (e.g., methyl, ethyl, n-propyl, n-butyl, n-amyl, n-hexyl, cyclohexyl, n-heptyl, n-octyl, 2-ethylhexyl, n-nonyl, 1,1,3-trimethylhexyl, n-decyl, n-dodecyl, cetyl, hexadecyl, 2-hexyldecyl, octadecyl, eicosyl, 2-octyldodecyl, docosyl, tetracosyl, 2-decyltetradecyl), a straight-chain, cyclic or branched substituted alkyl group having from 1 to 24 carbon atoms in the alkyl moiety other than the substituent group(s) (e.g., 6-phenoxyhexyl, 12-phenyldodecyl, 18-phenyloctadecyl, heptadecylfluorooctyl, 12-(p-chlorophenyl)dodecyl, 4-tert-butylcyclohexyl), a straight-chain, cyclic or branched unsubstituted alkenyl group having from 2 to 24 carbon atoms (e.g., vinyl, allyl, 2-methyl-2-butenyl, 4-pentenyl, 5-hexenyl, 3-hexenyl, 3-cyclohexenyl, 7-octenyl, 9-decenyl, oleyl, linoleyl, linolenyl), a straight-chain, cyclic or branched substituted alkenyl group having from 2 to 24 carbon atoms (e.g., 2-phenylvinyl, 9,10-dibromo-12-octadecenyl) and a substituted or unsubstituted aryl group having from 6 to 30 carbon atoms (e.g., phenyl, 1-naphthyl, 2-naphthyl, p-cresyl, p-ethylphenyl, p-tert-butylphenyl, p-tert-amylphenyl, octylphenyl, p-tert-octylphenyl, nonylphenyl, p-n-dodecylphenyl, m-octyloxyphenyl, biphenyl).

$Q_1$, $Q_2$ and $Q_3$ are each preferably a single bond, an oxygen atom and a group represented by formula —$N(R_3)$—, and more preferably at least two among $Q_1$, $Q_2$ and $Q_3$ are oxygen atoms. The term "single bond" as used above refers to the absence of an atom at the position of $Q_1$, $Q_2$ or $Q_3$.

L represents a divalent linkage group, preferably a group having the following formula (II-a):

$$\left(Y_1\left(J_1\right)_p\right)_a\left(Y_2\left(J_2\right)_q\right)_b\left(Y_3\left(J_3\right)_r\right)_s \qquad \text{(II-a)}$$

In formula (II-a), $Y_1$, $Y_2$ and $Y_3$ may be the same or different, and each represents a substituted or unsubstituted alkylene group having from 1 to 40 carbon atoms, or a substituted or unsubstituted arylene group having from 6 to 40 carbon atoms. The substituents of these groups include those recited with regard to the substituted alkyl group of $R_4$ or $R_5$ hereinabove. Preferable examples of the alkylene group include a methylene group, an ethylene group, a propylene group, a trimethylene group, a tetramethylene group, a pentamethylene group, a hexamethylene group, a 1,4-cyclohexylene group, an octamethylene group, a decamethylene group and a 2-methoxy-1,3-propylene group. Preferable examples of the arylene group include an o-phenylene group, a m-phenylene group, a p-phenylene group, a 3-chloro-1,4-phenylene group, a 1,4-naphthylene group and a 1,5-naphthylene group. Of these recited groups, an ethylene group, a propylene group, a trimethylene group, a tetramethylene group, a pentamethylene group, a hexamethylene group, a 1,4-cyclohexylene group, an octamethylene group, a decamethylene group, a m-phenylene group and a p-phenylene group are preferred in particular.

$J_1$, $J_2$ and $J_3$ may be the same or different, and each represents a divalent linkage unit. Suitable examples of such a linkage unit include a single bond, —O—, —S—, —CO—, —COO—, —OCO—, —$CON(R_7)$— (wherein $R_7$ represents a hydrogen atom, an unsubstituted alkyl group having from 1 to 6 carbon atoms, or a substituted alkyl group having from 1 to 6 carbon atoms in the alkyl moiety (which is substituted by at least one substituent such as those recited above with regard to the substituted alkyl group of $R_4$ or $R_5$), —$N(R_7)CO$— (wherein $R_7$ has the same meaning as defined above), —$CON(R_7)CO$— (wherein $R_7$ has the same meaning as defined above), —$N(R_7)CON(R_8)$— (wherein $R_7$ and $R_8$ may be the same or different, and each has the same meaning as those defined above as $R_7$), —$OCON(R_7)$— (wherein $R_7$ has the same meaning as defined above), —$N(R_7)COO$— (wherein $R_7$ has the same meaning as defined above), —$SO_2$—, —$SO_2N(R_7)$— (wherein $R_7$ has the same meaning as defined above), —$N(R_7)SO_2$— (wherein $R_7$ has the same meaning as defined above), —$N(COR_7)$— (wherein $R_7$ has the same meaning as defined above) and —$OP(=O)(OR_7)O$— (wherein $R_7$ has the same meaning as defined above). Of these linkage units, a single bond, —O—, —S—, —CO—, —COO—, —OCO—, —$CON(R_7)$— (wherein $R_7$ is a hydrogen atom, a methyl group, an ethyl group or a propyl group), —$N(R_7)CO$— (wherein $R_7$ has the same meaning as described above), —$SO_2N(R_7)$— (wherein $R_7$ has the same meaning as described above) and —$N(R_7)SO_2$— (wherein $R_7$ has the same meaning as described above) are particularly preferred.

p, q and r each independently represents an integer of from 0 to 5. Each of them is preferably an integer of from 0 to 3, more preferably 0 or 1. s is an integer of from 1 to 10, preferably an integer of from 1 to 5 and particularly preferably an integer of from 1 to 3.

a and b each independently represents an integer of from 0 to 50, preferably an integer of from 0 to 20, and particularly preferably an integer of from 0 to 10.

Z is preferably a hydrophilic anionic, cationic or amphoteric ionic group. In particular, an anionic group is preferred as Z from the viewpoint of photographic properties. Suitable examples of the anionic group include —COOM, —$SO_3M$, —$OSO_3M$, —$PO(OM)_2$ and —$OPO(OM)_2$ [wherein M represents a counter cation, preferably an alkali metal ion (e.g., lithium ion, sodium ion, potassium ion), an alkaline earth metal ion (e.g., magnesium ion, calcium ion) or an ammonium ion, and particularly preferably a sodium ion or a potassium ion]. Suitable examples of the cationic group include —$NH_3^+ \cdot X^-$, —$NH_2(R_9)^+ \cdot X^-$, —$NH(R_9)_2^+ \cdot X^-$ *and* —$N(R_9)_3^+ \cdot X^-$ [wherein $R_9$ represents an alkyl group having from 1 to 3 carbon atoms (e.g., methyl, ethyl, 2-hydroxyethyl, n-propyl, iso-propyl), preferably a methyl group or a 2-hydroxyethyl group; and $X^-$ represents a counter anion, preferably a halogen ion (e.g., fluorine ion, chlorine ion, bromine ion), a complex inorganic anion (e.g., hydroxide ion, sulfate ion, nitrate ion, phosphate ion) or an organic compound anion (e.g., oxalate ion, formate ion, acetate ion, propionate ion, methanesulfonate ion, p-toluenesulfonate ion), and particularly preferably a chlorine ion, a sulfate ion, a nitrate ion or an acetate ion].

Suitable examples of the amphoteric ionic group include those represented by the following formula (III):

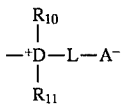

(III)

wherein D represents a nitrogen atom or a phosphorus atom; $R_{10}$ and $R_{11}$ each independently represents a hydrogen atom or an alkyl group having from 1 to 3 carbon atoms (e.g., methyl, ethyl, 2-hydroxyethyl, iso-propyl), particularly preferably a methyl group or a 2-hydroxyethyl group; L is the same divalent linkage group as defined in the foregoing formula (II); and $A^-$ represents an anionic group, preferably —COO—, —$SO_3$—, —$OSO_3$—, —$PO(OR_{12})O$— or —$OPO(OR_{12})O$— (wherein $R_{12}$ represents a hydrogen atom or an alkyl group having from 1 to 3 carbon atoms (e.g., methyl, ethyl, 2-hydroxyethyl, iso-propyl)).

$R_5$ in formula (II) is a monovalent group selected from the groups recited in the definition of $R_4$ or the groups defined as —L—Z. When $R_5$ is selected from the groups of the definition given to $R_4$, the two groups $R_4$ and $R_5$ in the same molecule may be the same or different in structure. In the other case $R_5$ is selected from the groups of the definition given to —L—Z, the group selected as $R_5$ and the moiety —L—Z present in the same molecule may be the same or different in structure. In particular, it is advantageous to select $R_5$ from the definition scope of $R_4$.

Further, it is preferable that the sum of the carbon atoms of $R_4$ and $R_5$ is preferably from 6 to 80, and more preferably from 8 to 50.

In addition, at least any two among the above-defined $R_4$, $R_5$ and L may combine with each other to form a ring structure. As for the ring structure formed therein, it does not have any particular restriction. From the viewpoint of the ring-structure stability, however, it is preferable that the ring has from 4 to 7 members. In particular, it is preferable for the ring to be a 5 or 6-membered ring.

The surface active compound of the present invention may be represented by combining two or more of formulae (II) via $R_4$, $R_5$ and L.

Specific examples of the surface active compound used in the present invention are illustrated below. However, the invention should not be construed as being limited to these examples.

PW-1

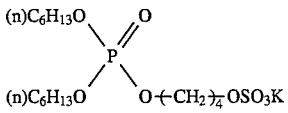

-continued

PW-2

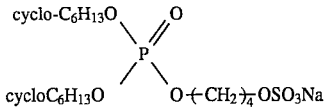

PW-3

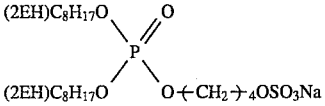

(2EH)$C_8H_{17}$ represenst a 2-ethylhexyl group.

PW-4

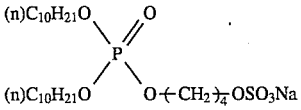

PW-5

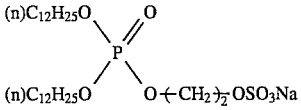

PW-6

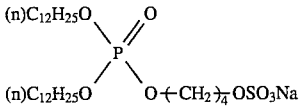

PW-7

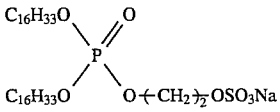

PW-8

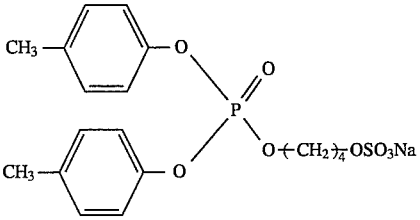

PW-9

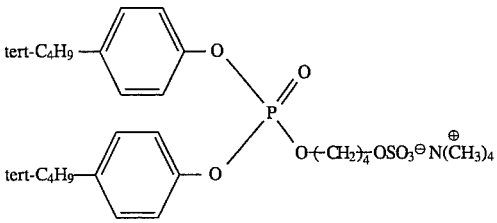

PW-10

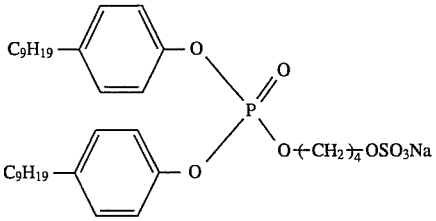

PW-11

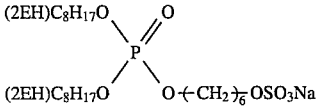

PW-12

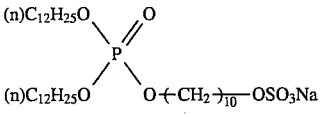

-continued
PW-13
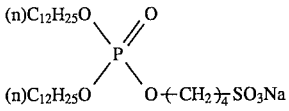
PW-14
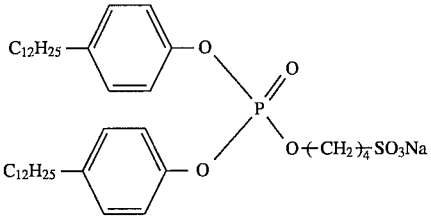
PW-15
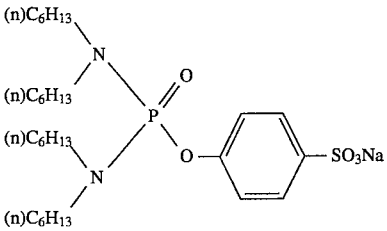
PW-16
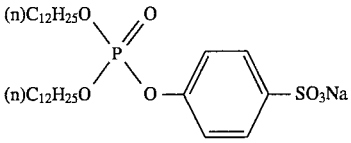
PW-17
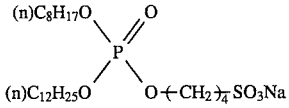
PW-18
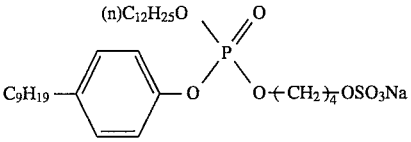
PW-19
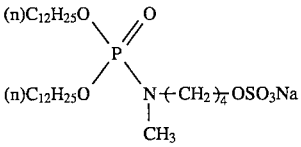
PW-20
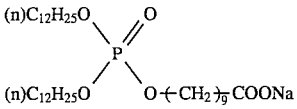
PW-21
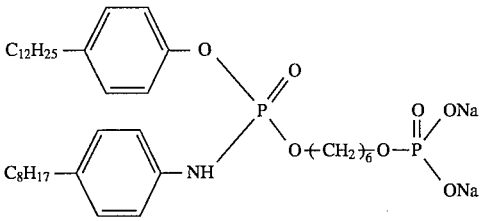
-continued
PW-22
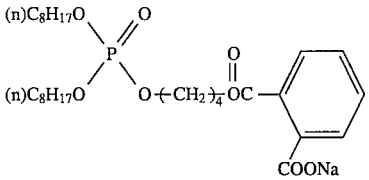
PW-23
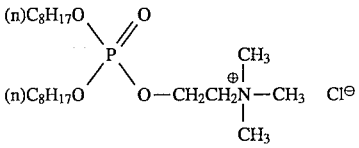
PW-24
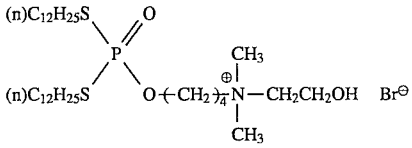
PW-25
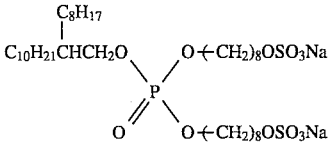
PW-26
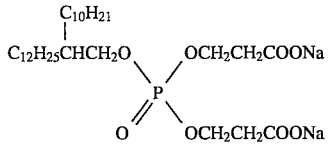
PW-27
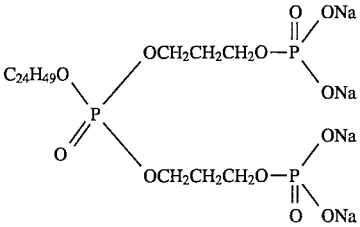
PW-28
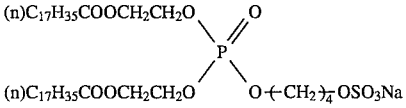
PW-29
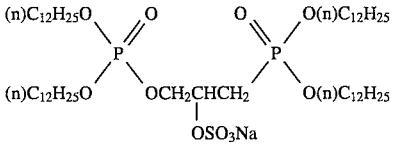
PW-30
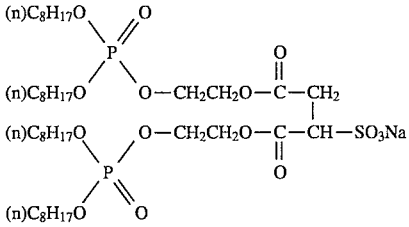

-continued

PW-31

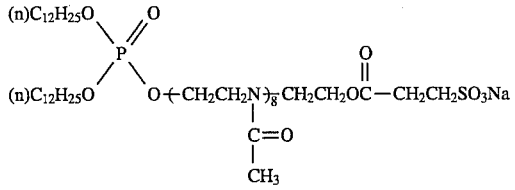

PW-32

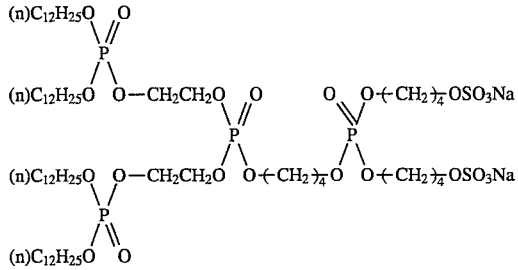

PW-33

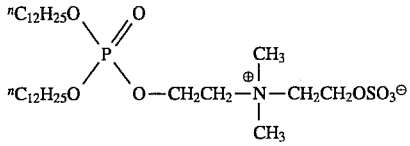

PW-34

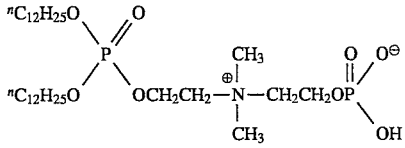

PW-35

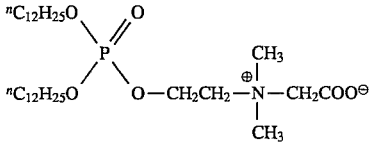

PW-36

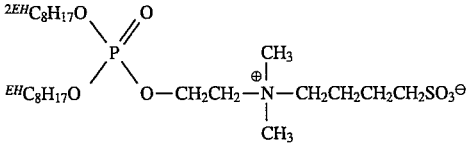

PW-37

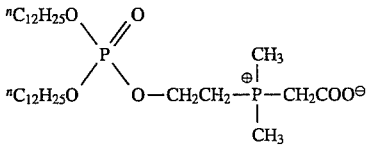

PW-38

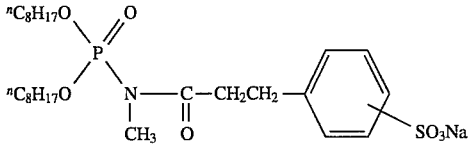

PW-39

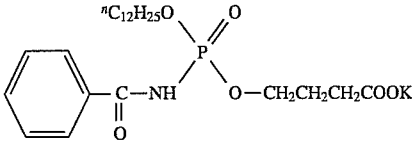

-continued

PW-40

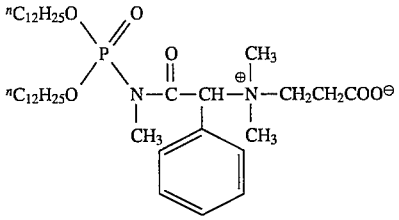

PW-41

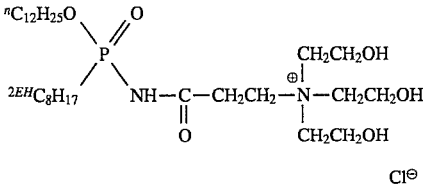

PW-42

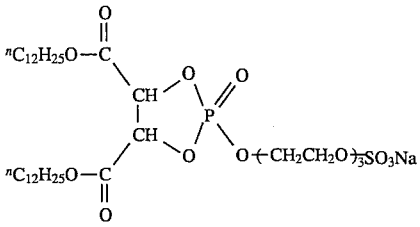

PW-43

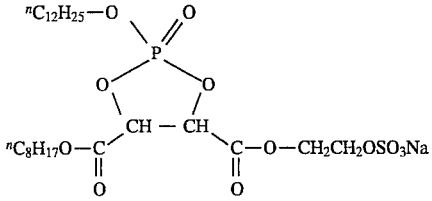

PW-44

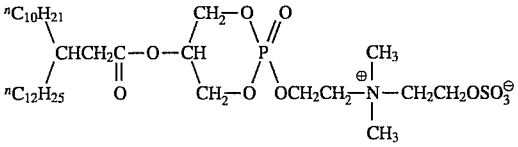

The present surface active compounds represented by formula (II) illustrated above can be obtained according to general synthesis methods. Several representatives of synthesis methods are described below, but the invention should not be construed as being limited to such representatives.

Synthesis Example 1: Synthesis of Compound PW-3

1) Synthesis of Di-2-ethylhexylphosphoryl Chloride

2-Ethylhexyl alcohol (26.0 g, 0.2 mol) was placed in a 200 ml three-necked flask equipped with a condenser and a stirring device, and cooled to 5° C. with stirring in an ice bath. Thereto, 15.3 g (0.1 mol) of phosphorus oxychloride was added dropwise over a 30-minute period at the inside temperature of 10° C. or less. After the completion of addition, the admixture was further stirred for 20 minutes as it was. Then, it was heated up to 25° C., and reacted for one hour under reduced pressure of 80–120mmHg. Further, the reaction mixture was heated up to 50° C. and reacted for 4 hours under the same reduced pressure as described above. The resulting reaction solution was cooled to room temperature to give 33.7 g of a transparent liquid (yield: 98.8%).

2) Synthesis of 4-Hydroxybutyl-di-2-ethylhexylphosphate 1,4-Butanediol (18.8 g, 0.2 mol) and triethylamine (15.2 g, 0.15 mol) were placed in a 200 ml three-necked flask equipped with a condenser and a stirring device. Thereto, 33.7 g (0.099 mol) of the di-2-ethylhexylphosphoryl chloride obtained above was added dropwise over a 30-minute period with stirring under cooling with water at the inside temperature of 15° C. or less. After the completion of addition, the admixture was further stirred for one hour as it was. Then, it was heated up to 50° C., and reacted for 3 hours. The reaction mixture obtained was cooled to room temperature, and admixed with 200 ml of ethyl acetate. The thus precipitated matter was filtered out, and the filtrate was concentrated under reduced pressure and then submitted to chromatographic separation and purification on a column of silica gel (eluent: ethyl acetate/hexane (2/1) mixture). Thus, 16.8 g of the intended compound was obtained (in a yield of 43.0%).

3) Synthesis of Compound PW-3

4-Hydroxybutyl-di-2-ethylhexyl phosphate synthesized above (15.8 g, 40 mmol) and 10 ml of chloroform were placed in a 200 ml three-necked flask equipped with a condenser and a stirring device. Thereto, 9.3 g (80 mol) of chlorosulfonic acid was added dropwise over a 30-minute period with stirring under cooling with ice-cold water at the inside temperature of 15° C. or less. After the completion of addition, the admixture was further stirred for 2 hour at room temperature as it was. The resulting reaction mixture was slowly admixed with 20 ml of water and further admixed with 50 ml of ethanol to make them into a solution. The pH of the mixture was adjusted to 7.1 by 1N sodium hydroxide. Furthermore, the solution was admixed with 300 ml of toluene to be azeotropically dehydrated five times. Thereafter, the resulting solution was concentrated, and then dissolved in 300 ml of ethyl acetate. Thereto, 80 g of anhydrous sodium sulfate was added, and allowed to stand for one night to effect dehydration. Therefrom, the insoluble matter was removed by filtration, and the filtrate was concentrated under reduced pressure. Thus, 19.3 g of the intended compound was obtained in a wax condition (yield: 97.1%), and identified as Compound PW-3 of the present invention by IR spectrum, $^1$H-NMR spectrum and elemental analysis.

$^1$H-NMR ($CDCl_3$, δ):

0.8–1.1 (hydrocarbon chain $CH_3$, 12H)
1.2–1.5 (hydrocarbon chain $CH_2$, 16H)
1.5–1.7 (hydrocarbon chain CH, 2H),
1.7–1.9 (tetramethylene chain $CH_2$, 4H)
3.8–4.0 (hydrocarbon chain —$CH_2O$—, 4H)
4.0–4.4 (tetramethylene chain —$CH_2O$—, 4H)

IR:

1320 $cm^{-1}$ (phosphorate)
1230 $cm^{-1}$ (sulfurate)

Synthesis Example 2: Synthesis of Compound PW-16

1) Synthesis of Di-dodecylphosphoryl Chloride

Dodecyl alcohol (223.6 g, 1.2 mol) and 500 ml of methylene chloride were placed in a 1 l three-necked flask equipped with a condenser and a stirring device. They were cooled with ice-cold water, and 55.8 g (0.6 mol) of phosphorus oxychloride was added dropwise thereto over a 30-minute period with stirring at the inside temperature of 10° C. or less. After the completion of addition, the admixture was further stirred for 20 minutes as it was. Then, it was heated up to room temperature, and reacted for one hour under reduced pressure of 80–120 mmHg. Further, the reaction mixture was heated up to 50° C. and undergo reaction for 3 hours under ordinary pressure. The resulting reaction solution was cooled to room temperature to give 246.6 g of a transparent liquid (yield: 87.6%).

2) Synthesis of Compound PW-16 p-Phenolsulfonic acid which was previously dehydrated (87.1 g, 0.5 mol) and 50.1 g of triethylamine (0.5 mol) were placed in a 1 l three-necked flask equipped with a condenser and a stirring device. Thereto, 216.81 g (0.5 mol) of the didodecylphosphoryl chloride obtained above was added dropwise over a 30-minute period with stirring under cooling with water at the inside temperature of 30° C. or less. After the completion of addition, the admixture was further stirred for one hour as it was. Then, it was heated up to 50° C., and reacted for 3 hours. The reaction mixture obtained was cooled to room temperature, and admixed with 200 ml of ethyl acetate. The thus prepared precipitate was filtered out, and the filtrate was concentrated under reduced pressure and then submitted to chromatographic separation and purification on a column of silica gel (eluent: ethyl acetate/hexane (4/1) mixture). The thus isolated material was dissolved in 150 ml of methanol, and admixed with 21.0 g (0.55 mol) of sodium hydroxide, followed by stirring for 8 hours under room temperature. The resulting reaction solution was further admixed with 500 ml of toluene, and to be azeotropically dehydrated five times. Thereafter, the solution was concentrated, and then dissolved in 800 ml of ethyl acetate. Thereto, 80 g of anhydrous sodium sulfate was added, and allowed to stand for one night to effect dehydration. Therefrom, the insoluble matter was removed by filtration, and the filtrate was concentrated under reduced pressure. Thus, 125.6 g of the intended compound was obtained in the form of wax (yield: 41.1%), and identified as Compound PW-22 of the present invention by IR spectrum, $^1$H-NMR spectrum and elemental analysis.

$^1$H-NMR ($CDCl_3$, δ):

0.8–1.1 (hydrocarbon chain $CH_3$, 6H)
1.2–1.5 ( hydrocarbon chain $CH_2$, 20H )
3.8–4.0 (hydrocarbon chain —$CH_2O$—, 4H)
7.3–8.1 (aromatic ring CH, 4H)

IR:

1320 $cm^{-1}$ (phosphorate)
1230 $cm^{-1}$ (sulfurate)

Synthesis Example 3: Synthesis of Compound PW-36

1) Synthesis of Di-2-ethylhexylphosphoryl Chloride

Di-2-ethylhexylphosphoryl chloride was synthesized in the same manner as in Synthesis Example 1 described above.

2) Synthesis of 2-Dimethylaminoethyl-di-2-ethylhexylphosphate

2-Dimethylaminoethanol (17.8 g, 0.2 mol) and 15.2 g (0.15 mol) of triethylamine were placed in a 200 ml three-necked flask equipped with a condenser and a stirring device. Thereto, 33.7 g (0.099 mol) of the di-2-ethylhexylphosphoryl chloride obtained above was added dropwise over a 30-minute period with stirring under cooling with water at the inside temperature of 30° C. or less. After the completion of addition, the admixture was further stirred for one hour as it was. Then, it was heated up to 50° C., and reacted for 3 hours. The reaction mixture obtained was cooled to room temperature, and admixed with 200 ml of ethyl acetate. The thus precipitated matter was filtered out, and the filtrate was concentrated under reduced pressure and then submitted to chromatographic separation and purification on a column of silica gel (eluent: ethyl acetate/hexane (5/1) mixture). Thus, 12.4 g of the intended compound was obtained (yield: 31.5%).

3) Synthesis of Compound PW-36

2-Dimethylaminoethyl phosphate synthesized above (11.8 g, 30 mmol) and 30 ml of toluene were placed in a 200 ml three-necked flask equipped with a condenser and a stirring device. Thereto, 4.1 g (33 mmol) of butanesultone was added over a 10-minute period with stirring under cooling with ice-cold water. After the completion of addition, the admixture was heated up to 150° C. and stirred for 6 hours as it was. The resulting reaction mixture was cooled to room temperature, and then admixed with 300 ml of acetone. The thus precipitate was filtered off to give the intended compound in the form of light-brown powder. The compound obtained was identified as Compound PW-36 by IR, $^1$H-NMR spectrum and elemental analysis.

Synthesis Example 4: Synthesis of Compound PW-42

1) Synthesis of Di-dodecyl Tartarate

In a 2 l three-necked flask equipped with a condenser and a stirring device, 372.7 g (2 mol) of dodecanol, 150.1 g (1 mol) of tartaric acid, 500 ml of toluene and 17.2 g (0.1 mol) of p-toluenesulfonic acid were placed, heated to 150° C. and reacted for 12 hours as azeotropic dehydration was run under refluxing toluene. The reaction solution was cooled to room temperature, and the toluene was distilled away under reduced pressure. The thus obtained oily material was submitted to chromatographic separation and purification on a column of silica gel (eluent: ethylacetate/hexane=1/1) to give 377.7 g of the intended compound as a colorless transparent liquid (yield: 77.6%).

2) Synthesis of Compound PW-42

The didodecyl tartarate obtained above (340.7 g, 0.7 mol) and 500 ml of ethylene chloride were placed in a 3 l three-necked flask equipped with a condenser and a stirring device, and stirred under cooling with ice-cold water. Thereto, 65.1 g (0.7 mol) of phosphorus oxychloride was added dropwise over a 30-minute period at the inside temperature of 10° C. or less. After the completion of addition, the admixture was further stirred for 20 minutes as it was. Then, it was heated to room temperature, and reacted for one hour under reduced pressure of 80–120mmHg. Further, the reaction mixture was heated up to 50° C. and reacted for 3 hours under ordinary pressure. The resulting reaction solution was cooled to room temperature.

Another 3 l three-necked flask equipped with a condenser and a stirring device was prepared, and therein were placed 1 l of ethyl acetate, 525.6 g (3.5 mol) of triethylene glycol and 101.2 g (1 mol) of triethylamine. Thereto, the whole volume of the reaction solution synthesized above was added dropwise over a 30-minute period with stirring under cooling with water at the inside temperature of 30° C. or less. After the completion of addition, the admixture was further stirred for one hour as it was. Then, it was heated up to 50° C., and undergo reaction for 3 hours. The reaction solution obtained was cooled to room temperature. The thus precipitate was filtered out, and the filtrate was concentrated under reduced pressure and then submitted to chromatographic separation and purification on a column of silica gel (eluent: ethyl acetate/hexane (3/1) mixture). Thus, the intended compound was obtained as a liquid.

The liquid obtained was admixed with 300 ml of chloroform to prepare a solution, and placed in a 300 ml three-necked flask equipped with a condenser and a stirring device. Thereto, 81.5 g (0.7 mol) of chlorosulfonic acid was added dropwise over a 60-minute period with stirring under cooling with ice-cold water at the inside temperature of 15° C. or less. After the completion of addition, the admixture was further stirred for 2 hour at room temperature as it was. The resulting reaction mixture was slowly admixed with 100 ml of water and further admixed with 500 ml of ethanol to make them into a solution. Then, the pH of the mixture was adjusted to 6.9 by 1N sodium hydroxide. Furthermore, the solution was admixed with 500 ml of toluene, and azeotropically dehydrated five times. Thereafter, the resulting solution was concentrated, and then dissolved in 500 ml of ethyl acetate. Thereto, 100 g of anhydrous sodium sulfate was added, and allowed to stand for one night to effect dehydration. Therefrom, the insoluble matter was removed by filtration, and the filtrate was concentrated under reduced pressure. Thus, 74.5 g of the intended compound was obtained in a wax condition (yield: 13.6%), and identified as Compound PW-42 of the present invention by IR spectrum, $^1$H-NMR spectrum and elemental analysis.

It is preferable that the present surface active compound is incorporated in at least one constituent layer of a photographic light-sensitive material, especially the same layer as the hydrazine derivative of the present invention.

The amount of the surface active compound of the present invention used depends upon what kind and thickness of the photographic light-sensitive material the compound is incorporated in, how many layers the compound is added to, what type and amount of the hydrazine derivative is used in combination therewith, whether or not other surfactants are used together, and so on. In general, however, the hydrazine derivative of the present invention is used in an amount of from 0.0001 to 1 g/m$^2$, preferably from 0.0005 to 0.5 g/m$^2$.

The halogen compositions of the silver halide emulsions of the silver halide photographic material used in the present invention are not particularly limited. Examples thereof include silver chloride, silver chlorobromide, silver iodochlorobromide, silver bromide and silver iodobromide. The silver halide grains may have any crystal shape, such as that of a cube, a tetradecahedron, an octahedron, amorphism or a plate. However, it is preferable for them to be cubic grains. The average grain size of the silver halide are preferably from 0.1 to 0.7 μm, more preferably from 0.2 to 0.5 μm. As for the distribution of grain sizes, it is preferable that the distribution be so narrow as to correspond to a variation coefficient of 15% or less, preferably 10% or less, wherein the variation coefficient refers to the value obtained by dividing the standard deviation regarding the grain sizes of silver halide grains by the average grain size and then multiplying the quotient by 100.

The silver halide grains may be uniform throughout, or differ between the inner part and the surface layer.

Photographic emulsions used in the present invention can be prepared using methods described in, e.g., P. Glafkides, *Chemie et Physique Photographique,* Paul Montel, Paris (1967), G. F. Duffin, *Photographic Emulsion Chemistry,* The Focal Press, London (1966), V. L. Zelikman et al, *Making and Coating Photographic Emulsion,* The Focal Press, London (1964), and so on.

Suitable methods for reacting a water-soluble silver salt with a water-soluble halide include, e.g., a single jet method, a double jet method, or a combination thereof.

A method in which silver halide grains are produced in the presence of excess silver ion (the so-called reverse mixing method) can be employed. On the other hand, the so-called controlled double jet method, in which the pAg of the liquid phase wherein silver halide grains are to be precipitated is maintained constant, may be employed. Further, it is preferable to carry out the grain formation using the so-called silver halide solvent, such as ammonia, thioethers and tetrasubstituted thioureas. Preferably, tetrasubstituted thioureas are used as the silver halide solvent, which are disclosed in JP-A-53-82408 and JP-A-55-77737. As for the thioureas, tetramethylthiourea and 1,3-dimethyl-2-imidazolinethione are preferably used.

According to the controlled double jet method and the grain formation method using a silver halide solvent, a silver halide emulsion having a regular crystal shape and a narrow distribution of grain sizes can be obtained with ease, and so these methods are useful for making the silver halide emulsions used in the present invention.

For the purpose of rendering the grain sizes uniform, it is also preferable that the grain growth is accelerated within the limits of critical saturation degree by using a method of changing the addition speed of silver nitrate or an alkali halide depending on the speed of grain growth, as discrobed in British Patent No. 1,535,016, JP-B-48-36890 and JP-B-

52-16364 (the term "JP-B" as used herein means an "examined Japanese patent publication"), or a method of changing the concentrations of the aqueous solutions, as described in British Patent No. 4,242,445 and JP-A-55-158124.

For attainment of high contrast and low fog density, it is desirable to incorporate at least one metal selected from rhodium, rhenium, ruthenium, osmium and iridium into silver halide grains used in the silver halide photographic material of the present invention. The content of such a metallic compound is preferably from $1\times10^{-9}$ to $1\times10^{-5}$ mol, more preferably from $1\times10^{-8}$ to $5\times10^{-6}$ mol, per mol of silver. These metals may be used as a mixture of two or more thereof. The metals can be distributed evenly throughout the grains, or can be distributed in a specified pattern as described in JP-A-63-29603, JP-A-2- 306236, JP-A-3-167545, JP-A-4-76534, JP-A-5-273746 and JP-A-6-110146.

The rhodium compounds which can be used in the present invention are water-soluble ones. Suitable examples thereof include rhodium(III) halides and rhodium complex salts containing as ligands halogen atoms, amines, oxalato groups or so on, such as hexachlororhodium(III) complex salts, hexabromorhodium(III) complex salts, hexaamminerhodium(III) complex salts and trioxalatorhodium(III) complex salts. In using these rhodium compounds, they are dissolved in water or an appropriate solvent. In order to stabilize the solution of a rhodium compound, a conventional method, that is, a method of adding an aqueous solution of hydrogen halogenide (e.g., hydrochloric acid, hydrobromic acid, hydrofluoric acid) or an alkali halide (e.g., KCl, NaCl, KBr, NaBr), can be adopted. Instead of using a water-soluble rhodium compound, it is possible to incorporate rhodium into emulsion grains by adding rhodium-doped silver halide grains to the silver halide preparation system and dissolving the grains therein.

Those compounds can be properly added at the time silver halide emulsion grains are formed, or at any stage prior to the emulsion coating. In particular, it is preferable for them to be added at the time the emulsion is formed, and thereby to be incorporated into silver halide grains.

As for the iridium compounds used in the present invention, various ones including, e.g., hexachloroiridium, hexaammineiridium, trioxalatoiridium and hexacyanoiridium salts can be used in the present invention. In using these iridium compounds, they are dissolved in water or an appropriate solvent. In order to stabilize the solution of an iridium compound, a conventional method, that is, a method of adding an aqueous solution of hydrogen halogenide (e.g., hydrochloric acid, hydrobromic acid, hydrofluoric acid) or an alkali halide (e.g., KCl, NaCl, KBr, NaBr), can be adopted. Instead of using a water-soluble iridium compound, it is possible to incorporate iridium into emulsion grains by adding iridium-doped silver halide grains to the silver halide preparation system and dissolving the grains therein.

The silver halide grains used in the present invention may be doped with rhenium, ruthenium or osmium.

In doping with such metal, the metal is added to an emulsion in the form of water-soluble complex salt disclosed in, for example, JP-A-63-2042, JP-A-1-285941, JP-A-2-20852, JP-A- 2-20855. In particular, complexes having the coordination number of 6 and represented by the following formula are preferable:

$$[ML^1{}_6]^{-n}$$

wherein M represents Ru, Re or Os, $L^1$ represents a ligand, and n is 0, 1, 2, 3 or 4.

In this case, a counter ion is of no importance, so that an ammonium ion or an alkali metal ion is used as the counter ion.

As for the ligands, halides, cyanide, cyanate, nitrosyl or thionitrosyl ligands are suitable examples thereof. Specific examples of the metal complexes which can be used in the present invention are given below. However, the invention should not construed as being limited to these examples.

$[ReCl_6]^{-3}$ $[ReBr_6]^{-3}$ $[ReCl_5(NO)]^{-2}$ $[Re(NS)Br_5]^{-2}$ $[Re(NO)(CN)_5]^{-2}$ $[Re(O)_2(CN)_4]^{-3}$ $[RuCl_6]^{-3}$ $[RuCl_4(H_2O)_2]^{-2}$ $[RuCl_5(NO)]^{-2}$ $[RuBr_5(NS)]^{-2}$ $[Ru(CN)_6]^{-4}$ $[Ru(CO)_3Cl_3]^{-2}$ $[Ru(CO)Cl_5]^{-2}$ $[Ru(CO)Br_5]^{-2}$ $[OsCl_5]^{-3}$ $[OsCl_5(NO)]^{-2}$ $[Os(NO)(CN)_5]^{-2}$ $[Os(NS)Br_5]^{-2}$ $[Os(CN)_6]^{-4}$ $[Os(O)_2(CN)_4]^{-4}$

The addition of these metal complexes can be properly carried out at the time silver halide emulsion grains are formed, or at any stage prior to the emulsion coating. In particular, it is preferable for them to be added at the time the emulsion is formed, and thereby to be incorporated into silver halide grains.

In order to incorporate such a metal complex as cited above into silver halide grains by adding it during the grain formation, there can be adopted the method of adding in advance a solution prepared by dissolving in water the metal complex powder or its mixture with NaCl or KCl to either a water-soluble salt solution or a water-soluble halide solution for the grain formation; the method of forming silver halide grains by simultaneously admixing three solutions, namely a silver salt solution, a halide solution and the foregoing metal complex powder-containing solution as the third solution; or the method of pouring a water solution of the metal complex in a desired amount into the reaction vessel under grain formation. In particular, it is preferable to adopt the method of adding to an aqueous halide solution a solution prepared by dissolving in water the metal complex powder together with NaCl or KCl.

In order to make such a metal complex adsorb to the grain surface, an aqueous solution thereof may be poured into the reaction vessel in a required amount just after the grain formation, during or at the conclusion of physical ripening, or at the time of chemical ripening.

Various kinds of iridium compounds can be used in the present invention. Specific examples of an iridium compound which can be used include hexachloroiridium, hexaammineiridium, trioxalatoiridium, hexacyanoiridium, and so on. In using these compounds, they are dissolved in water or an appropriate solvent. In order to stabilize a solution of iridium compound, a prevailing method, or a method of adding a water solution of hydrogen halide (e.g., hydrochloric acid, hydrobromic acid, hydrofluoric acid) or an alkali halide (e.g., KCl, NaCl, KBr, NaBr), can be adopted. Instead of using a water-soluble iridium compound, iridium can be introduced into a silver halide emulsion by adding silver halide grains which are in advance doped with iridium to another silver halide system under preparation to dissolve the grains therein.

Silver halide grains used in the present invention may be doped by other heavy metal salts. In particular, the doping of an Fe complex salt, such as $K_4[Fe(CN)_6]$, is preferred.

Further, the silver halide grains used in the present invention may contain metal atoms, such as cobalt, nickel, palladium, platinum, gold, thallium, copper and lead. These metals are preferably used in an amount of from $1\times10^{-9}$ to $1\times10^{-4}$ mol per mol of silver halide. The metals can be contained in the grains by the addition in the form of metal salt, including single, double and complex salts, during the grain formation.

The silver halide emulsions used in the present invention may be chemically sensitized. As for the chemical sensitization, known methods, such as a sulfur sensitization method, a selenium sensitization method, a tellurium sensitization method, a reduction sensitization method and a precious metal sensitization method, can be adopted. These methods can be used alone or in combination. In the combined use, it is preferable to combine, e.g., a sulfur sensitization method and a gold sensitization method, a sulfur sensitization method, a selenium sensitization and a gold sensitization method, or a sulfur sensitization method, tellurium sensitization method and a gold sensitization method.

In the sulfur sensitization method adopted in the present invention, sensitization can be generally effected by adding a sulfur sensitizer to an emulsion and stirring the emulsion for a prescribed time under a temperature of 40° C. or higher. As for the sulfur sensitizer, known compounds including not only sulfur compounds contained in gelatin but also thiosulfates, thioureas, thiazoles, rhodanines and so on can be used. Of these sulfur sensitizers, thiosulfates and thiourea compounds are preferred. The amount of a sulfur sensitizer added, though it is changed depending on various conditions, such as the pH and the temperature at the time of chemical sensitization and the size of silver halide grains, is in the range of $10^{-7}$ to $10^{-2}$ mol, preferably $10^{-5}$ to $10^{-3}$ mol, per mol of silver halide.

Selenium sensitizers which can be used in the present invention include those disclosed in known patents. In general, selenium sensitization can be effected by adding an unstable selenium compound and/or a nonunstable selenium compound to the silver halide emulsion and agitating the resulting emulsion at a high temperature, preferably 40° C. or more, for a definite time. Suitable examples of the unstable selenium compounds include those disclosed in JP-B-44-15748, JP-B-43-13489, JP-A-4-25832, JP-A-4-109240, JP-A-4-271341, JP-A- 4-25832, JP-A-4-109240 and JP-A-4-324855. Specific examples of the unstable selenium compound include isoselenocyanates (e.g., aliphatic isoselenocyanates such as allylisoselenocyanate), selenoureas, selenoketones, selenoamides, selenocarboxylic acids (e.g., 2-selenopropionic acid, 2-selenobutyric acid), selenoesters, diacylselenides (e.g., bis(3-chloro-2,6-dimethoxybenzoyl)selenide), selenophosphates, phosphinoselenides, and colloidal metallic selenium. The compounds represented by formula (VIII) or (IX) described in JP-A-4-324855 are preferably used.

On the other hand, examples of the nonunstable selenium compounds which can be used in the present invention include those disclosed in JP-B-46-4553, JP-B-52-34492 and JP-B-52- 34491. Specific examples of such nonunstable selenium compounds include selenious acid, potassium selenocyanide, selenazoles, quaternary salts of selenazoles, diaryl selenides, diaryl diselenides, dialkyl selenides, dialkyl diselenides, 2-selenazolidinedione, 2-selenoxazolidinethione, and derivatives of these compounds.

Tellurium sensitizers which can be used in the present invention are compounds capable of producing silver telluride, which is presumed to act as a sensitization nucleus, at the surface or the inside of silver halide grains. The production rate of silver telluride in a silver halide emulsion can be examined by the method disclosed in JP-A-5-313284.

Specific examples of the tellurium sensitizers which can be used include the compounds disclosed in U.S. Pat. Nos. 1,623,499, 3,320,069 and 3,772,031; British Patent Nos. 235,211, 1,121,496, 1,295,462 and 1,396,696; Canadian Patent No. 800,958, JP-A-4-204640, JP-A-4-271341, JP-A-4-333043 and JP-A-5-303157; *J. Chem. Soc. Commun.*, 635 (1980); *ibid.* 1102 (1979); *ibid.* 645 (1979); *J. Chem. Soc. Perkin. Trans.*, 1,2191 (1980); S. Patai (compiler), *The Chemistry of Organic Selenium and Tellurium Compounds*, Vol. 1 (1986); and *ibid.* Vol. 2 (1987). In particular, the compounds represented by formulae (II), (III) and (IV) in JP-A-5-303157 are preferred.

The amounts of selenium and tellurium sensitizers used in the present invention, though they depend on the conditions under which the silver halide grains are ripened chemically, are generally from $10^{-8}$ to $10^{-2}$ mol, preferably from $10^{-7}$ to $\times 10^{-3}$ mol, per mol of silver halide. The chemical sensitization, although the present invention does not impose any particular restriction thereon, is generally carried out under a condition such that the pH is from 6 to 11, the pAg is from 6 to 11, preferably from 7 to 10, and the temperature is from 40° to 95° C., preferably from 45° to 85° C.

Examples of precious metal sensitizers used in the present invention include gold, platinum and palladium. In particular, gold sensitizers are preferred. Suitable examples of such gold sensitizers include chloroauric acid, potassium chloroaurate, potassium aurithiocyanate and auric sulfide. These gold sensitizers can be used in an amount of $10^{-7}$ to $10^{-2}$ mol per mol of silver halide.

In a process of producing silver halide emulsion grains used in the present invention or allowing the produced grains to ripen physically, a cadmium salt, a zinc salt, a lead salt, and a thallium salt may be present.

Further, reduction sensitization can be adopted in the present invention. Examples of such reduction sensitizer include stannous salts, amines, formamidinesulfinic acid and silane compounds.

To the silver halide emulsions used in the present invention, thiosulfonate compounds may be added according to the method described in European Patent (EP) No. 293,917.

The present photographic material may contain only one kind of silver halide emulsion or not less than two kinds of silver halide emulsions (differing in average grain size, halide composition, crystal habit or chemical sensitization condition).

Spectral sensitizing dyes used in the present invention are not particularly limited.

The amount of sensitizing dyes added is, though depending on the shape and the size of silver halide grains, from $4\times10^{-8}$ to $8\times10^{-3}$ mol per mol of silver halide. In cases where the size of silver halide grains ranges, e.g., from 0.1 to 1.3 μm, it is preferable that the amount of sensitizing dyes added is from $2\times10^{-7}$ to $3.5\times10^{-6}$ mol, particularly preferably from $6.5\times10^{-7}$ to $2.0\times10^{-6}$ mol, per $m^2$ of surface area of silver halide grains.

The light-sensitive silver halide emulsions used in the present invention may be spectrally sensitized by sensitizing dyes to extend their sensitivities to blue rays of relatively long wavelengths, green rays, red rays or infrared rays. Examples of the sensitizing dyes include cyanine dyes, merocyanine dyes, complex cyanine dyes, complex merocyanine dyes, holopolar cyanine dyes, styryl dyes, hemicyanine dyes, oxonol dyes and hemioxonol dyes.

The sensitizing dyes useful in the present invention include those described in *Research Disclosure*, Item 17643, Section IV-A (December 1978, p. 23); *ibid*, Item 1831, Section X (Aug. 1978, p. 437) and the references cited in these literatures.

In special cases where various type of scanners are used for exposure, it is advantageous to choose sensitizing dyes which can impart spectral sensitivities suited for spectral characteristics of the light source of the scanner used.

For instance, it is advantageous to choose (A) the simple merocyanines disclosed in JP-A-60-162247, JP-A-2-48653, U.S. Pat. No. 2,161,331, West German Patent No. 936,071 and JP-A- 5-11389 when an argon laser is used as a light source, (B) the trinuclear cyanine dyes disclosed in JP-A-50-62425, JP-A-54- 18726 and JP-A-59-102229 when an He-Ne laser is used as a light source, (C) the thiacarbocyanines disclosed in JP-B-48-42172, JP-B-51-9609, JP-B-55-39818, JP-A-62-284343 and JP-A-2-105135 when an LED or red semiconductor laser is used as a light source, and (D) the tricarbocyanines disclosed in JP-A-59- 191032 and JP-A-60-80841 and the 4-quinoline nucleus-containing dicarbocyanines represented by formula (IIIa) or (IIIb) in JP-A- 59-192242 and JP-A-3-67242 when an infrared semiconductor layer is used as a light source.

Those sensitizing dyes may be used individually or in combination. Combinations of sensitizing dyes are often used for the purpose of supersensitization. Materials which can exhibit a supersensitizing effect in combination with sensitizing dyes although they themselves do not spectrally sensitize silver halide emulsions or do not absorb light in the visible region may be incorporated in the emulsions.

Useful sensitizing dyes, supersensitizing combinations of dyes, and materials capable of exhibiting a supersensitizing effect are described in, e.g., *Research Disclosure,* Vol. 176, Item 17643, Section IV-J (December 1978, p. 23).

In particular, the dyes cited below are preferably used for an argon laser light source:

S1-1

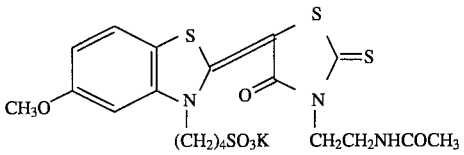

S1-2

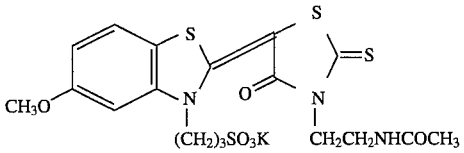

S1-3

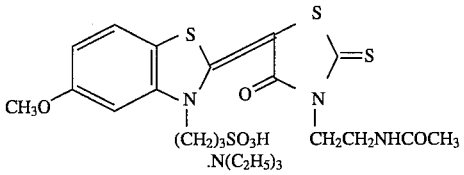

S1-4

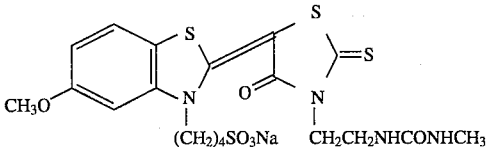

S1-5

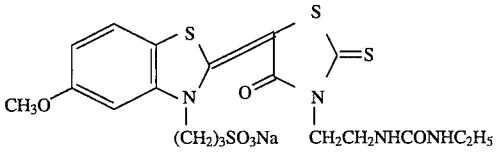

S1-6

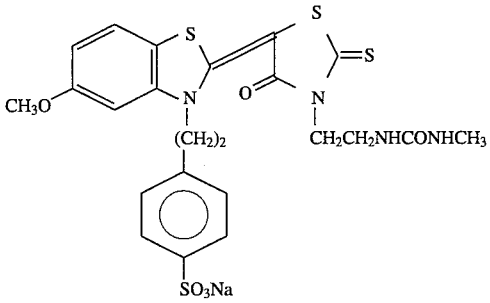

-continued

S1-7

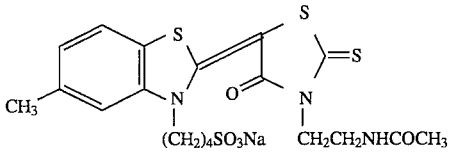

S1-8

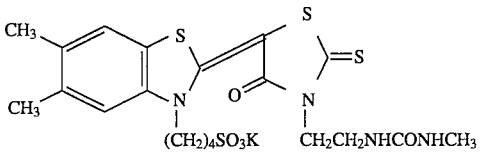

S1-9

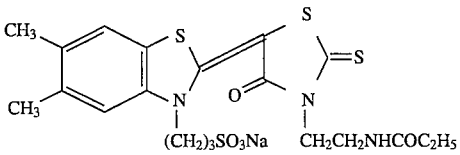

S1-10

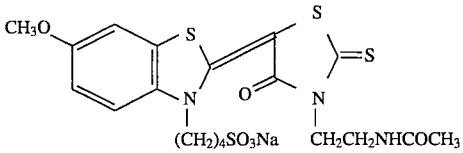

S1-11

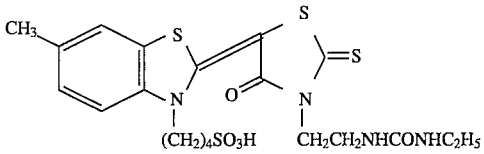

S1-12

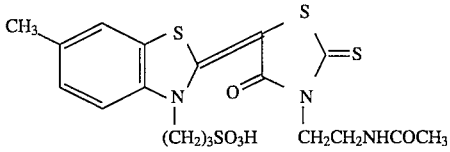

S1-13

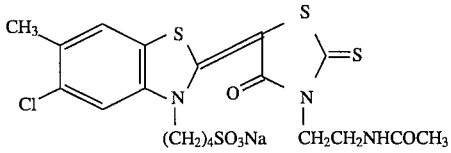

In addition to the dyes illustrated above, the sensitizing dyes represented by formula (I) in JP-A-4-228745 (from page 8, the end line, to page 13, 4th line) are particularly suitable for a helium-neon laser light source. Typical representatives of such sensitizing dyes are illustrated below. In addition, the sensitizing dyes represented by formula (I) of JP-A-6-75322 can be preferably used.

S2-1

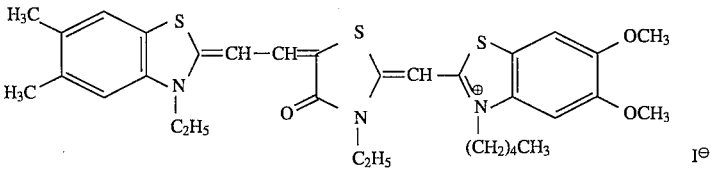

-continued
S2-2
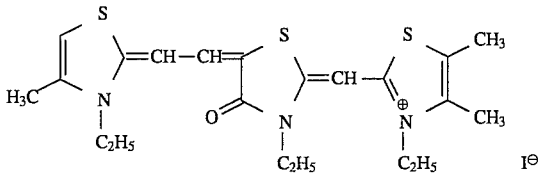
S2-3
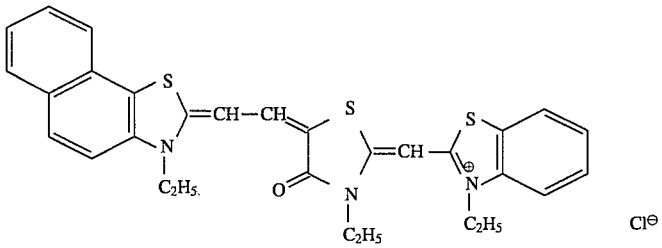
S2-4
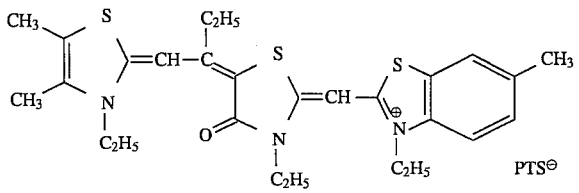
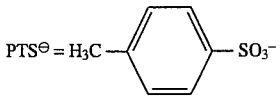
S2-5
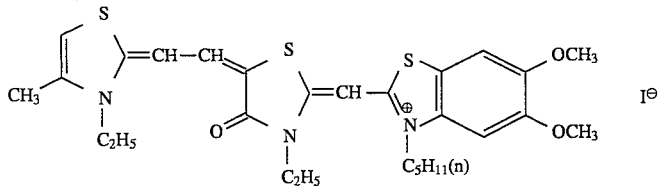
S2-6
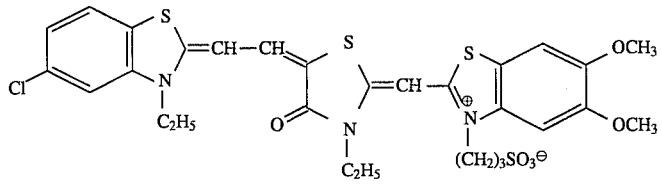
S2-7
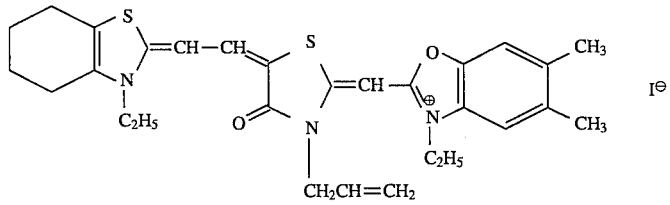
S2-8
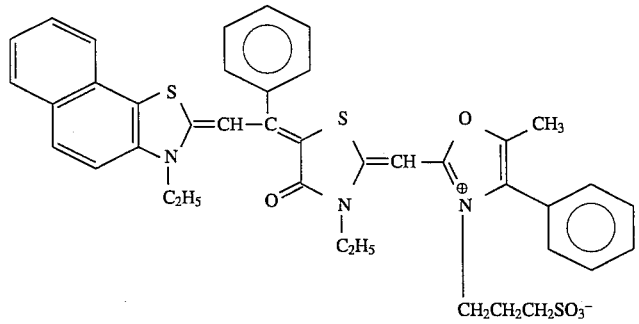

For LED and red semiconductor laser light sources, the dyes illustrated below are particularly suitable.
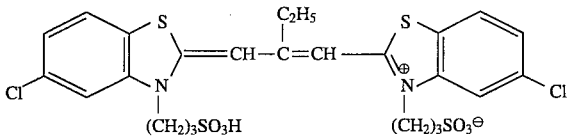
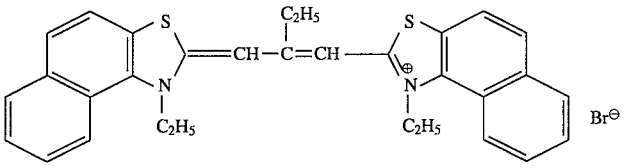
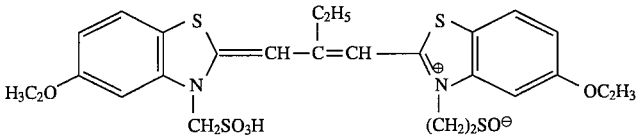
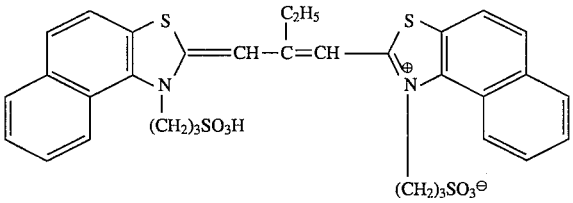
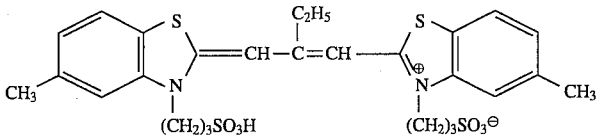
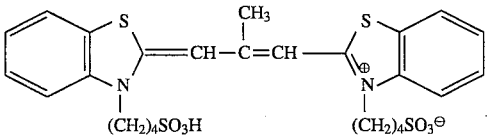
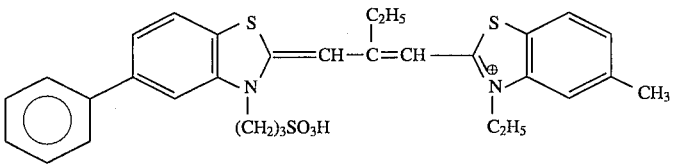
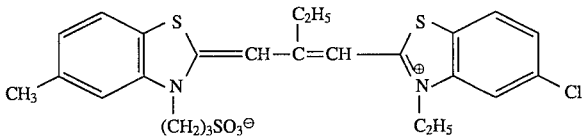
For an infrared semiconductor laser light source, the dyes illustrated below are particularly suitable.

S4-1
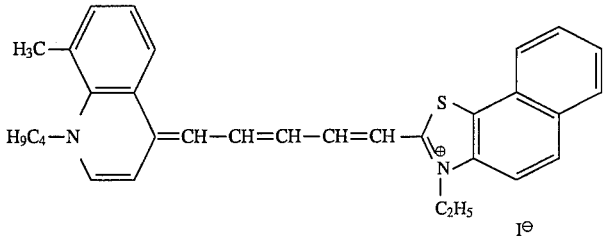
S4-2
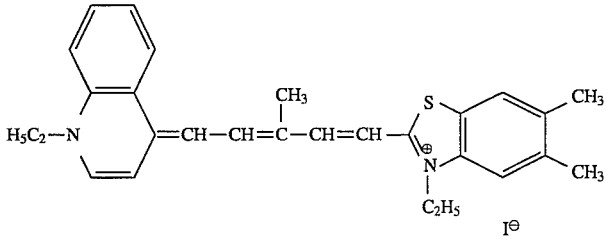
S4-3
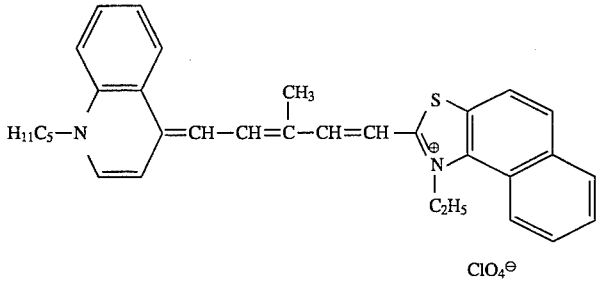
S4-4
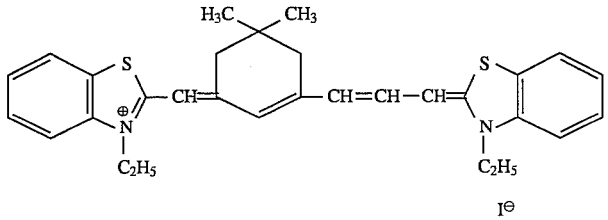
S4-5
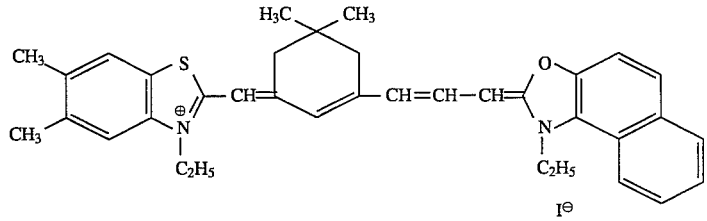
S4-6
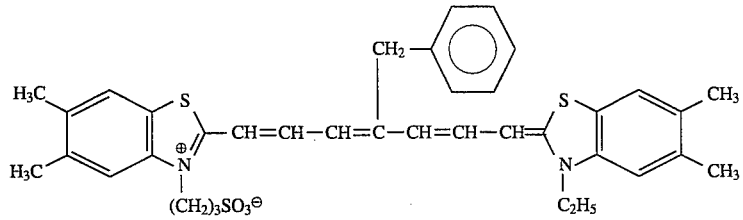
For a white light under which photographs are taken with a camera, the sensitizing dyes represented by general formula (IV) in Japanese Patent Application No. 5-201254 (from page 20, 14th line, to page 22, 23rd line) are suitable. Specific examples thereof are illustrated below.

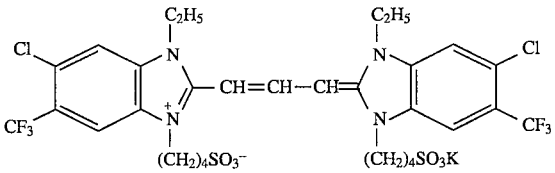
S5-1
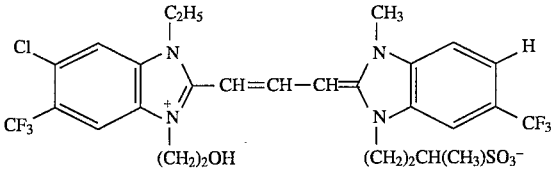
S5-2
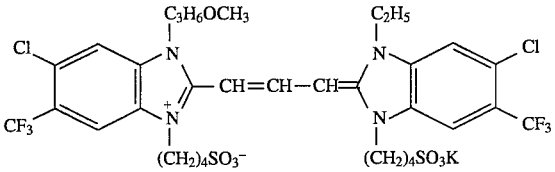
S5-3
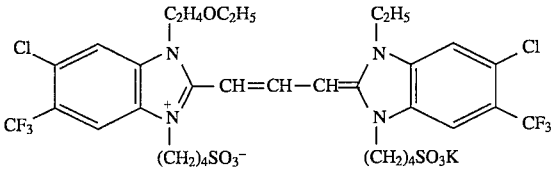
S5-4
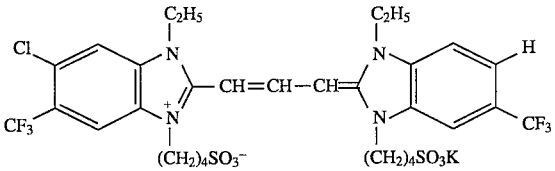
S5-5
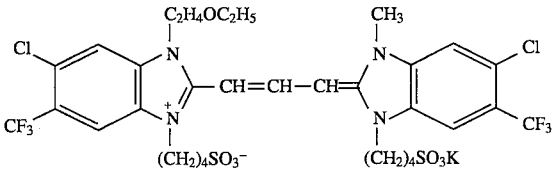
S5-6
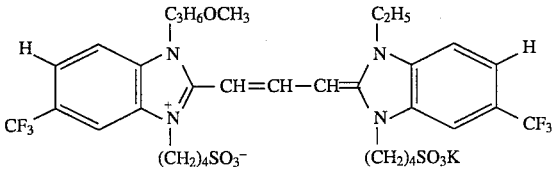
S5-7
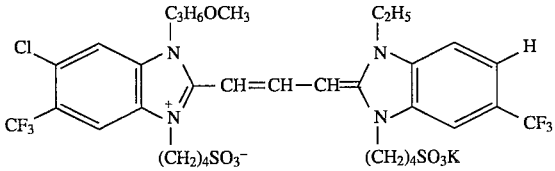
S5-8
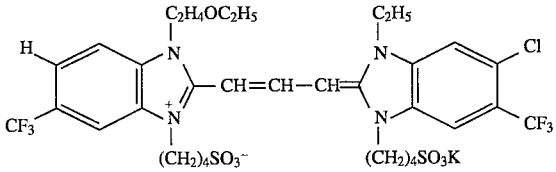
S5-9

-continued
S5-10
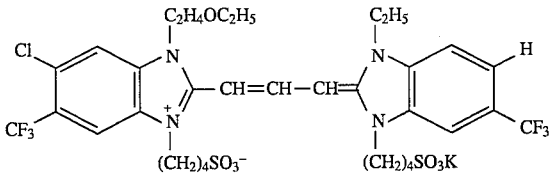
S5-11
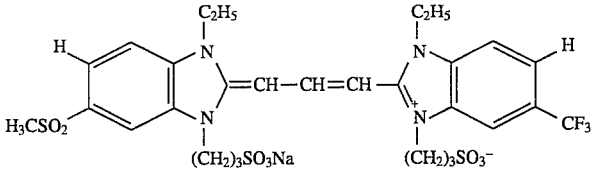
S5-12
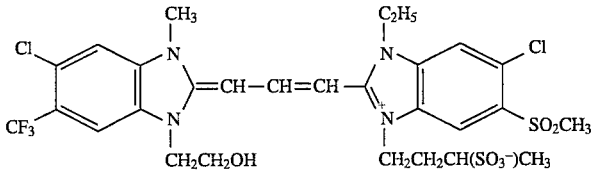
S5-13
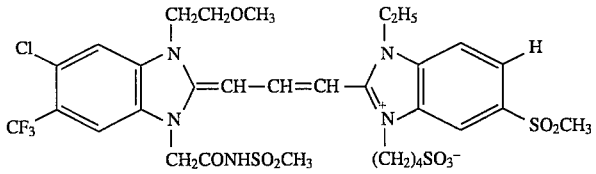
S5-14
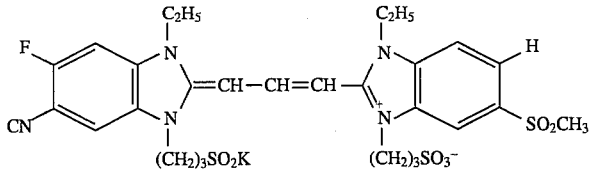
S5-15
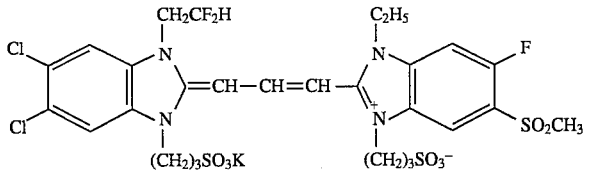
S5-16
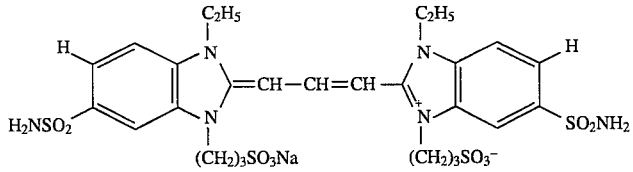
S5-17
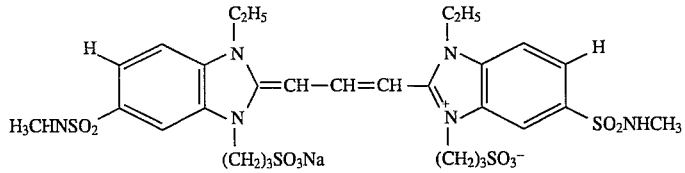
S5-18
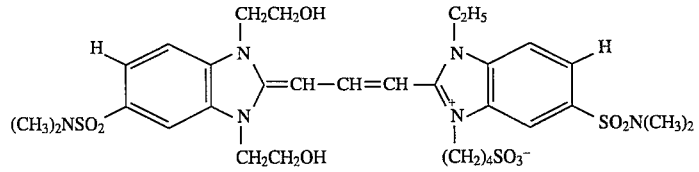

-continued

S5-19

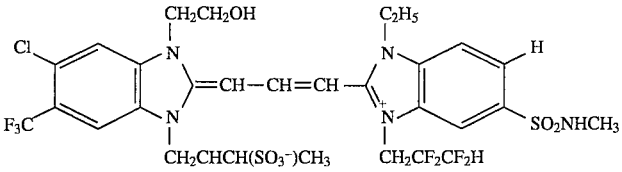

S5-20

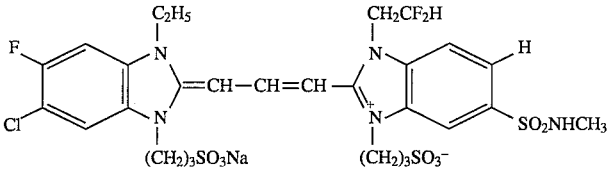

Developing agents for a developer used in the present invention are not particularly limited. From the standpoint of the capacity for ensuring excellent dot quality, however, dihydroxybenzenes are preferably contained. Specifically, combinations of dihydroxybenzenes with 1-phenyl-3-pyrazolidones or those of dihydroxybenzenes with p-aminophenols may also be used. In addition, ascorbic acids can be advantageously used as a developing agent.

Specific examples of the dihydroxybenzene type developing agents which can be used in the present invention include hydroquinone, chlorohydroquinone, bromohydroquinone, isopropylhydroquinone, methylhydroquinone, 2,3-dichlorohydroquinone, 2,5-dichlorohydroquinone, 2,3-dibromohydroquinone, 2,5-dibromohydroquinone, and 2,5-dimethylhydroquinone. In particular, hydroquinone is preferred.

Specific examples of the 1-phenyl-3-pyrazolidone type developing agents or derivatives thereof which can be used in the present invention include 1-phenyl-3-pyrazolidone, 1-phenyl- 4,4-dimethyl-3-pyrazolidone, 1-phenyl-4-methyl-4-hydroxymethyl- 3-pyrazolidone, 1-phenyl-4,4-dihydroxymethyl-3-pyrazolidone, 1-phenyl-5-methyl-3-pyrazolidone, 1-p-aminophenyl- 4,4-dimethyl-3-pyrazolidone, 1-p-tolyl-4,4-dimethyl- 3-pyrazolidone, and 1-p-tolyl-4-methyl-4-hydroxymethyl- 3-pyrazolidone.

Specific examples of the p-aminophenol type developing agent which can be used in the present invention include N-methyl-p-aminophenol, p-aminophenol, N-(β-hydroxyethyl)-p-aminophenol, N-(4-hydroxyphenyl)glycine, 2-methyl-p-aminophenol and p-benzylaminophenol. In particular, N-methyl-p-aminophenol is preferred.

In general, it is preferable that the developing agent is used in an amount of from 0.05 to 0.8 mol per liter of developer. When the combination of a dihydroxybenzene with a 1-phenyl-3-pyrazolidone or p-aminophenol is used as a developing agent, it is preferable that the former is used in an amount of from 0.05 to 0.5 mol per liter of developer and the latter is used in an amount of 0.06 mol per liter of developer or less.

Examples of sulfites used as preservatives in the present invention include sodium sulfite, potassium sulfite, lithium sulfite, ammonium sulfite, sodium bisulfite, potassium metabisulfite and formaldehyde-sodium bisulfite. The sulfites are preferably used in a concentration of at least 0.3 mol/l, especially at least 0.4 mol/l, while the upper limit of the sulfite concentration is desirably 2.5 mol/l, especially 1.2 mol/l. When dihydroxybenzenes are used as a developing agent, on the other hand, ascorbic acids are preferred as preservatives, and added in an amount of from 0.03 to 0.12 by mol to the developing agent.

Alkali agents used for pH adjustment include a pH modifier and a pH buffer, such as sodium hydroxide, potassium hydroxide, sodium carbonate, potassium carbonate, sodium tertiary phosphate, potassium tertiary phosphate, sodium silicate, and potassium silicate.

The pH of the developer used for the development of the present invention is preferably from 9.0 to less than 11.0. The developer whose pH is 11.0 or more is unpreferable because the deterioration thereof with a lapse of time becomes serious; while the developer whose pH is less than 9.0 cannot ensure sufficient contrast for images. The pH is more preferably from 9.8 to 10.8.

Additives which may be contained in the developer in addition to the above-cited ones include a compound such as boric acid, and borax; a development inhibitor such as sodium bromide, potassium bromide, and potassium iodide; an organic solvent such as ethylene glycol, diethylene glycol, triethylene glycol, dimethylformamide, methyl cellosolve, hexylene glycol, ethanol, and methanol; and an antifoggant such as a mercapto compound (e.g., 1-phenyl-5-mercaptotetrazole, sodium 2-mercaptobenzimidazole-5-sulfonate), an indazole compound (e.g., 5-nitroindazole), a benzotriazole compound (e.g., 5-methylbenzotriazole). Further, the developer may contain a toning agent, a surfactant, an antifoaming agent, a water softener, and a hardener, if desired. In particular, the amino compounds disclosed in JP-A-56-106244 and the imidazole compounds disclosed in JP-B-48-35493 are preferably added from the standpoint of accelerating the development acceleration and increasing the sensitivity.

Furthermore, the developer used in the present invention can contain the compounds disclosed in JP-A-56-24347 and JP-A-4-362942 as a silver stain inhibitor, compounds disclosed in JP-A-62-212651 as a development unevenness inhibitor, and the compounds disclosed in JP-A-61-267759 as a dissolving aid.

The developer used in the present invention may contain the boric acid disclosed in JP-A-62-186259, the saccharides (e.g., saccharose), oximes (e.g., acetoxime), phenols (e.g., 5-sulfosalicylic acid) or tertiary phosphates (e.g., sodium tertiary phosphate, potassium tertiary phosphate) disclosed in JP-A-60-93433, as a buffer. The boric acid is preferred as a buffer.

A fixer is an aqueous solution which contains a fixing agent and, if needed, a hardener (e.g., water-soluble aluminum compounds), acetic acid and dibasic acid (e.g., tartaric acid, citric acid or the salts thereof). The pH of the fixer is preferably 3.8 or more, and particularly preferably from 4.0 to 5.5.

Examples of the fixing agent include sodium thiosulfate and ammonium thiosulfate. From the viewpoint of fixing speed, ammonium thiosulfate is preferred in particular. The amount of the fixing agent used is generally from about 0.1 to about 5 mol/l, though it can be changed properly.

The water-soluble aluminum salts which act mainly as a hardener in the fixer are generally known as a hardener for acidic hardening fixers, with specific examples including aluminum chloride, aluminum sulfate and potassium alum.

As for the dibasic acid described above, tartaric acid, a salt thereof, citric acid and a salt thereof can be used alone or a mixture of two or more thereof. These compounds are effective when they are used in an amount of at least 0.005 mol, especially from 0.01 to 0.03 mol, per liter of fixer.

Suitable examples of a salt of tartaric acid include potassium tartarate, sodium tartarate, potassium sodium tartarate, ammonium tartarate, and ammonium potassium tartarate.

Suitable examples of citric acid and derivatives thereof used in the present invention include sodium citrate, and potassium citrate.

Further, the fixer can contain preservatives (e.g., sulfites, bisulfites), pH buffers (e.g., acetic acid, boric acid), pH modifiers (e.g., ammonia, sulfuric acid), image retention improvers (e.g., potassium iodide) and chelating agents, if desired. As for the pH buffers, it is preferable that they be used in an amount of from 10 to 40 g, preferably from 18 to 25 g, per liter of fixer, because the developer used in the present invention has high pH.

Suitable temperature and time for fixation are similar to those for development. More specifically, it is preferable that the fixing time is from 10 seconds to 1 minute under a temperature of from about 20° C. to about 50° C.

The water used for washing may contain antimolds (e.g., compounds described in Horiguchi, *Bohkin Bohbai no Kagaku (Antibacterial and Moldproof Chemistry)* and JP-A-62-115154), washing accelerators (e.g., sulfites), and chelating agents.

The photographic material which has been developed and subsequently fixed in the foregoing manners is subjected to washing, followed by drying. The washing is carried out in order to completely remove silver salts eluted by fixation. A suitable washing time is from 10 seconds to 3 minutes under a temperature ranging from about 20° C. to about 50° C. The drying is carried out at a temperature of from about 40° C. to about 100° C. The drying time can be changed properly depending on the surrounding conditions, but it is generally from about 5 seconds to 3 minutes and 30 seconds.

Automatic developing machines of roller conveyance type are described in, e.g., U.S. Pat. Nos. 3,025,779 and 3,545,971, and the present invention refers them to simply as processors of roller conveyance type. A processor of roller conveyance type involves four processes, namely development, fixation, washing and drying processes. Also, it is most advantageous for the present method to follow those four processes, although the present method does not exclude other processes (e.g., stop process). Herein, it is possible to save water by applying a 2- or 3-stage countercurrent washing system to the washing process.

The developer used in the present invention is preferably stored in a package material slightly pervious to oxygen. Further, it is advantageous to apply the replenishing system disclosed in JP-A-62-91939 to the developer of the present invention.

The photographic materials of the present invention are not particularly restricted as to additives, and so various kinds of additives can be used therein. However, those disclosed in the following patent specifications can be preferably added thereto.

| Item | Reference and Passage therein |
|---|---|
| 1) Nucleation accelerators | The compounds represented by formulae (I), (II), (III), (IV), (V) and (VI) disclosed in JP-A-6-82943; the compounds represented by formulae (II-m) to (II-p), and Exemplified Compounds II-1 to II-22, disclosed in JP-A-2-103536, from page 9, right upper column, line 13, to page 16, left upper column, line 10; the compounds disclosed in JP-A-1-179939. |
| 2) Surfactants, and Antistatic agent | JP-A-2-122363, at page 9, from right upper column, line 7, to right lower column, line 7; and JP-A-2-18542, from page 2, left lower column, line 13, to page 4, right lower column, line 18. |
| 3) Antifoggants, Stabilizer | JP-A-2-103536, from page 17, right lower column, line 19, to page 18, right upper column, line 4, and page 18, right lower column, from line 1 to line 5; the thiosulfinic acid compounds disclosed in JP-A-1-237538. |
| 4) Polymer latexes | JP-A-2-103536, page 18, left lower column, from line 6 to line 20. |
| 5) Compounds containing an acidic group | JP-A-2-103536, from page 18, left lower column, line 6, to page 19, left upper column, line 1; JP-A-2-55349, from page 8, light lower column, line 13, to page 11, left upper column, line 8. |
| 6) Matting agent, Slipping agent, and Plasticizers | JP-A-2-103536, at page 19, from left upper column, line 15, to right upper column, line 15. |
| 7) Hardeners | JP-A-2-103536, at page 18, right upper column, from line 5 to line 17. |
| 8) Dyes | JP-A-2-103536, at page 17, right lower column, from line 1 to line 18; the solid dyes disclosed in JP-A-2-294638 and JP-A-5-11382. |
| 9) Binders | JP-A-2-18542, at page 3, right lower column, from line 1 to line 20. |
| 10) Black spot inhibitors | The compounds disclosed in U.S. Pat. No. 4,956,257 and JP-A-1-118832. |
| 11) Redox compounds | The compounds represented by formula (I) disclosed in JP-A-2-301743 (especially Compounds 1 to 50); the compounds represented by formulae (R-1), (R-2) and (R-3), Exemplified Compounds 1 to 75, disclosed at pages 3 to 20 in JP-A-3-174143; the compounds disclosed in JP-A-5-257239 and JP-A-4-278939. |
| 12) Monomethine compounds | The compounds represented by formula (II) in JP-A-2-287532 (especially Exemplified Compounds II-1 to II-26). |
| 13) Dihydroxybenzenes | The compounds disclosed in JP-A-3-39948, from page 11, left upper column to page 12, left lower column, and those disclosed in EP-A-452772. |

The present invention will now be illustrated in greater detail by reference to the following examples. However, the invention should not be construed as being limited to these examples.

EXAMPLE 1

Production of Silver Halide Photographic Materials

Preparation of Emulsion A

Emulsion A was prepared in the following manner: To an aqueous gelatin solution containing sodium chloride and 1,3-dimethyl- 2-imidazolidinethione, an aqueous solution of silver nitrate and an aqueous halide solution containing potassium bromide, sodium chloride, $3.5\times10^{-7}$ mol/mol silver of $K_3IrCl_6$ and $2.0\times10^{-7}$ mol/mol silver of $K_2Rh(H_2O)Cl_5$ were added with stirring in accordance with a double jet method to form silver chlorobromide grains having an average grain size of 0.25 μm and a chloride content of 70 mol %. Thereafter, the emulsion obtained was washed using a conventional flocculation method, and then admixed with 40 g/mol silver of gelatin and further with 7 mg/mol silver of sodium benzenethiosulfonate and 2 mg/mol silver of benzenesulfinic acid. The resulting emulsion was adjusted to pH 6.0 and pAg 7.5, and then chemically sensitized at 60° C. by adding 2 mg/mol silver of sodium thiosulfate and 4 mg/mol silver of chloroauric acid so as to achieve the optimal sensitivity. Thereto, 150 mg of 4-hydroxy- 6-methyl-1,3,3a,7-tetrazaindene as a stabilizer and 100 mg of Proxel as an antiseptic were further added. The thus obtained emulsion grains were silver chlorobromide grains having a cubic crystal form, an average grain size of 0.25 μm and a chloride content of 70 mol % (variation coefficient: 10%).

Preparation of Emulsion-Coated Samples

On a polyethylene terephthalate film support having as an undercoat a moisture proofing layer containing vinylidene chloride, the following UL layer, EM layer, PC layer and OC layer were coated successively in this order from the support to prepare a sample.

The preparation manner and the coated amount of each constituent layer were as follows:

[UL Layer]

A polyethylacrylate dispersion was added to an aqueous gelatin solution in such an amount that the proportion of polyethylacrylate to gelatin might be 30% by weight, and the resulting admixture was coated at 0.5 g/m$^2$ in terms of gelatin.

[EM Layer]

To the above-described Emulsion A were added $5\times10^{-4}$ mol/mol silver of a sensitizing dye (Compound (S-1) illustrated below), $5\times10^{-4}$ mol/mol silver of another sensitizing dye (Compound (S-2) illustrated below), $3\times10^{-4}$ mol/mol silver of a mercapto compound (Compound (a) illustrated below), $4\times10^{-4}$ mol/mol silver of another mercapto compound (Compound (b) illustrated below), $4\times10^{-4}$ mol/mol silver of a triazine compound (Compound (c) illustrated below), $2\times10^{-3}$ mol/mol silver of 5-chloro- 8-hydroquinoline, $5\times10^{-4}$ mol/mol silver of a surface active compound according to the present invention, as set forth in Table 1, or a comparative surface active compound as illustrated below, and $4\times10^{-4}$ mol/mol silver of a nucleation accelerator (Compound (A-1) illustrated below). Thereto, 100 mg of hydroquinone and 30 mg/m$^2$ of sodium N-oleyl-N-methyltaurine were further added. Then, the resulting emulsion was admixed with $5\times10^{-4}$ mol of a hydrazine derivative according to the present invention, as set forth in Table 1, 200 mg/m$^2$ of a water-soluble latex (Copolymer (d) illustrated below), 200 mg/m$^2$ of a polyethylacrylate dispersion, 200 mg/m$^2$ of a latex copolymer of methylacrylate, sodium 2-acrylamide-2-methylpropanesulfonate and 2-acetoacetoxyethylmethacrylate (88:5:7 by weight), 200 mg/m$^2$ of colloidal silica having an average grain size of 0.02 μm and 200 mg/m$^2$ of 1,3-divinylsulfonyl- 2-propanol as a hardener. The thus obtained emulsion was adjusted to pH 5.65 with the addition of acetic acid, and then coated at 3.5 g/m$^2$ in terms of silver.

[PC Layer]

An aqueous gelatin solution were admixed with a polyethylacrylate dispersion in an amount corresponding to the proportion of 50% by weight to the gelatin, 5 mg/m$^2$ of sodium ethylsulfonate and 10 mg/m$^2$ of 1,5-dihydroxy-2-benzaldoxime, and coated at 0.5 g/m$^2$ in terms of silver.

[OC Layer]

Gelatin (0.5 g/m$^2$), 40 mg/m$^2$ of amorphous $SiO_2$ matting agent having an average particle size of about 3.5 μm, 0.1 g/m$^2$ of methanol silica, 100 mg/m$^2$ of polyacrylamide, 20 mg/m$^2$ of silicone oil, and coating aids constituted of 5 mg/m$^2$ of a fluorine-containing surfactant (Compound (e) illustrated below) and 100 mg/m$^2$ of sodium dodecylbenzenesulfonate were coated in a layer.

Comparative Surface Active Compounds

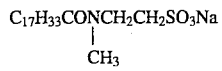

(W-1)

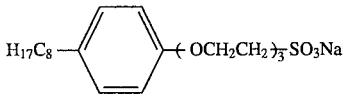

(W-2)

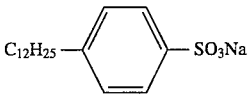

(W-3)

Compound (S-1)

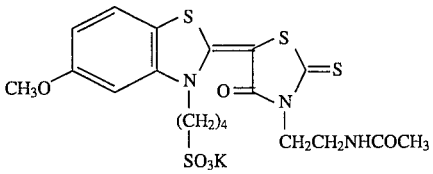

Compound (S-2)

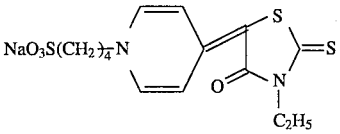

Compound (a)

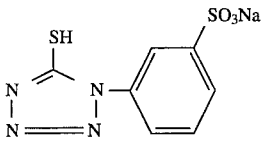

Compound (b)

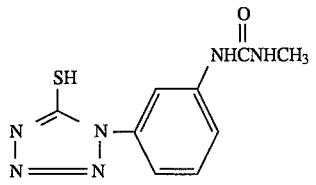

Compound (c)

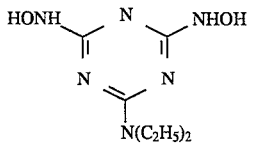

Compound (A-1)

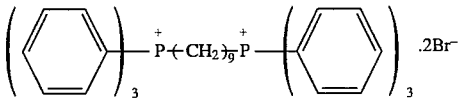

Compound (d)

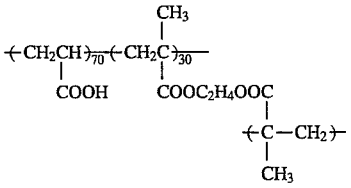

Compound (e)

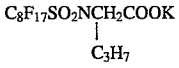

Each of the samples prepared in the above-described manner was coated with backing and back-protecting layers having the following compositions respectively.

| [Backing Layer] | |
|---|---|
| Gelatin | 3 g/m$^2$ |
| Polyethylacrylate latex | 2 g/m$^2$ |
| Surfactant | 40 mg/m$^2$ |
| Sodium p-dodecylbenzenesulfonate | |
| $CH_2{=}CHSO_2CH_2CONH$ — $(CH_2)_2$ — $CH_2{=}CHSO_2CH_2CONH$ | 110 mg/m$^2$ |
| $SnO_2$/Sb (ratio: 90/10 by weight, average grain size: 0.20 μm) | 200 mg/m$^2$ |
| Mixture of Dye [a], Dye [b] and Dye [c] | |
| Dye [a] | 70 mg/m$^2$ |
| Dye [b] | 70 mg/m$^2$ |
| Dye [c] | 90 mg/m$^2$ |
| Dye [a] | |

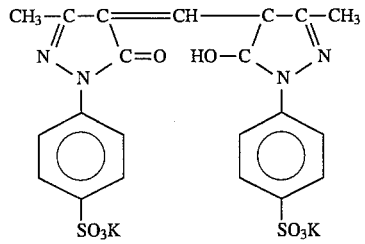

Dye [b]

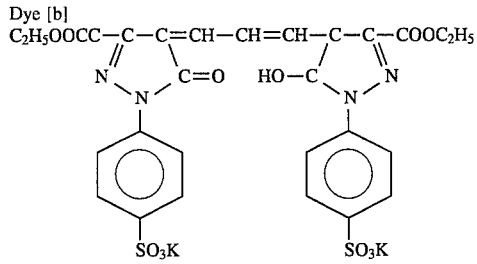

Dye [c]

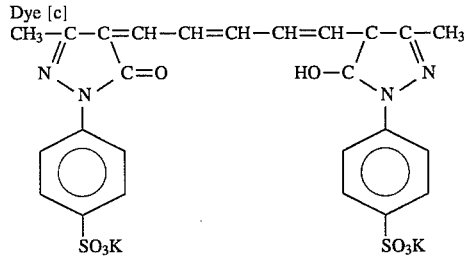

| [Back Protecting Layer] | |
|---|---|
| Gelatin | 0.8 mg/m$^2$ |
| Fine particles of polymethylmethacrylate (average particle size: 4.5 μm) | 30 mg/m$^2$ |
| Sodium dihexyl-α-sulfosuccinate | 15 mg/m$^2$ |
| Sodium p-dodecylbenzenesulfonate | 15 mg/m$^2$ |
| Sodium acetate | 40 mg/m$^2$ |

Evaluation of Photographic Properties (1) Exposure and Photographic Processing:

Each sample was exposed to a xenon flash lamp (light emitting time: $10^{-5}$ sec.) through both a step wedge and an interference filter having its peak at 488 nm, and then developed for 30 seconds at 35° C. with a Developer A having the following composition. Thereafter, it was subjected successively to fixation, washing and drying operations.

| Developer A | |
|---|---|
| Potassium hydroxide | 35.0 g |
| Diethylenetriaminepentaacetic acid | 2.0 g |
| Potassium carbonate | 12.0 g |
| Sodium metabisulfite | 40.0 g |
| Potassium bromide | 3.0 g |
| Hydroquinone | 25.0 g |
| 5-Methylbenzotriazole | 0.08 g |
| 4-Hydroxymethyl-4-methyl-1-phenyl-3-pyrazolidone | 0.45 g |
| 2,3,5,6,7,8-Hexahydro-2-thioxo-4-(1H)-quinazoline | 0.04 g |
| Sodium 2-mercaptobenzimidazole-5-sulfonate | 0.15 g |
| Sodium erysorbate | 3.0 g |
| Water to make | 1 l |

The pH of Developer A was adjusted to 10.5 with potassium hydroxide.

A fixer having the following composition was used.

| Fixer | |
|---|---|
| Ammonium thiosulfate | 359.1 ml |
| Disodium ethylenediaminetetraacetate dihydrate | 2.26 g |
| Sodium thiosulfate pentahydrate | 32.8 g |
| Sodium sulfite | 64.8 g |
| NaOH | 37.2 g |
| Glacial acetic acid | 87.3 g |
| Tartaric acid | 8.76 g |
| Sodium gluconate | 6.6 g |
| Aluminum sulfate | 25.3 g |
| pH (adjusted with sulfuric acid or NaOH) | 4.85 |
| Water to make | 1 l |

(2) Evaluation of Image Contrast:

An indication showing the contrast of an image (a gamma value (γ)) was defined as the slope of a straight line connecting the two points on the characteristic curve, namely those corresponding to (fog+density 0.3) and (fog+density 3.0). More specifically, the gamma value was defined by the following equation:

$$\text{Gamma}=(3.0-0.3)/[\log(\text{exposure providing the density } 3.0)-\log(\text{exposure providing the density } 0.3)]$$

Thus, this definition indicates that the greater the gamma value, the more contrast in the photographic characteristics of the photographic material.

(3) Evaluation of Dot Quality (DQ):

Dots obtained using a photographic material which had been exposed through a contact screen were observed with a magnifying glass in order to examine them for definition and smoothness. The dot quality was evaluated by five ranks by grading the observation result in accordance with the following criterion: The grade 5 represents that both definition and smoothness are on the most satisfactory level and the grade 1 represents that they are on the lowest level. The dot quality of the grade 3 or higher is required for attaining a practically allowable level of definition and smoothness in the on/off part of an image when a scanner exposure is carried out in practice.

(4) Stability Test of Coating Composition Standing in Dissolved Condition

In order to examine the influence of a hydrazine derivative upon the stability of each coating composition standing in a dissolved condition (abbreviated as "coating solution") for coating the EM layer, two kinds of samples were prepared in the same manner, except that in coating the EM layer the coating solution which had just been prepared was used for one sample but the coating solution which had undergone 12 hours' standing after the preparation was used for the other sample. These samples were each examined for gamma and dot quality, and changes in these characteristics between them were determined. Further, the hydrazine derivative content in each coating solution was determined by HPLC (high-speed liquid chromatography) just after the preparation and after 12 hours' standing respectively. The remaining rate of the hydrazine derivative was calculated from the following formula:

$$\text{Remaining Rate } (\%)=[C_{t=12}/C_{t=0}]\times 100$$

wherein $C_{t=12}$ stands for the hydrazine derivative content in the coating solution which has undergone 12 hours' standing after the preparation and $C_{t=0}$ stands for the hydrazine derivative content in the coating solution which has just been prepared.

TABLE 1

| Sample No. | Formula: Hydrazine Derivative | Formula: Surface Active compound | Photographic Properties: Coating Just After Preparation: Gamma | Photographic Properties: Coating Just After Preparation: Dot Quality | Photographic Properties: Coating After 12 Hours' Standing: Gamma | Photographic Properties: Coating After 12 Hours' Standing: Dot Quality | Remaining Rate (%) of Hydrazine Derivative | Note |
|---|---|---|---|---|---|---|---|---|
| 1-1 | I-38 | — | 20 | 5 | 9 | 2 | 41 | Comparison |
| 1-2 | I-38 | W-1 | 20 | 5 | 10 | 2 | 49 | Comparison |
| 1-3 | I-38 | W-2 | 20 | 5 | 11 | 2 | 43 | Comparison |
| 1-4 | I-38 | W-3 | 19 | 5 | 12 | 3 | 56 | Comparison |
| 1-5 | I-38 | PW-5 | 22 | 5 | 21 | 5 | 98 | Invention |
| 1-6 | I-38 | PW-6 | 21 | 5 | 20 | 5 | 97 | Invention |
| 1-7 | I-38 | PW-16 | 20 | 5 | 20 | 5 | 94 | Invention |
| 1-8 | I-38 | PW-19 | 22 | 5 | 21 | 5 | 95 | Invention |
| 1-9 | I-4 | PW-5 | 15 | 4 | 15 | 4 | 93 | Invention |
| 1-10 | I-30 | PW-5 | 17 | 4 | 16 | 4 | 94 | Invention |
| 1-11 | I-31 | PW-5 | 16 | 4 | 16 | 4 | 95 | Invention |
| 1-12 | I-36 | PW-5 | 17 | 4 | 16 | 4 | 97 | Invention |
| 1-13 | I-40 | PW-5 | 20 | 5 | 20 | 5 | 97 | Invention |
| 1-14 | I-42 | PW-5 | 17 | 4 | 16 | 4 | 95 | Invention |
| 1-15 | I-46 | PW-5 | 17 | 4 | 17 | 4 | 96 | Invention |

As is apparent from the results shown in Table 1, the present surface active compounds were successful in not only inhibiting the hydrazine derivatives from decomposing but also preventing the characteristic curve from showing soft gradation. In accordance with an embodiment of the present invention, therefore, it becomes possible to consistently produce photographic materials which are suitable for an Ar laser scanner and can exhibit high contrast photographic characteristics even when they are processed with a developer whose pH is lower than 11.

EXAMPLE 2

Production of Silver Halide Photographic Materials

Preparation of Emulsion B

Emulsion B was prepared in the same manner as Emulsion A, except that the chemical sensitization was carried out at 60° C. by adding 1 mg/mol silver of a selenium sensitizer illustrated below, 1 mg/mol silver of sodium thiosulfate and 4 mg/mol silver of chloroauric acid so as to achieve the optimal sensitivity.

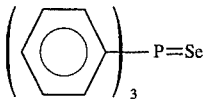

Preparation of Emulsion-coated Samples

Samples were prepared in the same manner as in Example 1, except that the sensitizing dyes incorporated in each EM Layer were replaced by $2.1\times10^{-4}$ mol/mol silver of Compound (S-3) illustrated below and either Emulsion A or Emulsion B prepared above was used as the emulsion constituting the EM layer of each sample. The hydrazine derivatives added to the individual EM layers and their respective amounts used, and further the surface active compounds added to those layers are set forth in Table 2. The amount added of the surface active compounds was the same as in Example 1.

Compound (S-3)

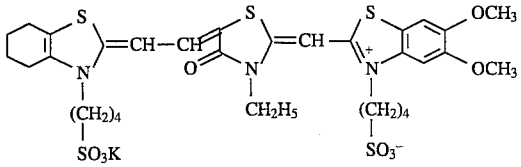

Evaluation of Photographic Characteristics (1) Exposure and Photographic Processing:

Each sample was exposed to a xenon flash lamp (light emitting time: $10^{-6}$ sec. ) through both a step wedge and an interference filter having its peak at 633 nm, and then developed for 30 seconds at 35° C. with Developer A described in Example 1. Thereafter, it was subjected successively to fixation (the same as in Example 1), washing and drying operations.

(2) Evaluation of Sensitivity:

The sensitivity was expressed in terms of the logarithm of the exposure amount providing the density 1.5.

(3) Evaluation of Image Contrast:

Image contrast of each sample was evaluated by the same method as in Example 1.

(4) Stability Test of Coating Composition Standing in Dissolved Condition

In order to examine the stability of each coating composition standing in a dissolved condition (abbreviated as "coating solution") for coating the EM layer, two kinds of samples were prepared in the same manner, except that in coating the EM layer the coating solution which had just been prepared was used for one sample but the coating solution which had undergone 12 hours' standing after the preparation was used for the other sample. These samples were each examined for sensitivity, and the change therein (ΔS) was determined. When a photographic material has ΔS of 0.05 or less, consistent production thereof is possible.

$$\Delta S=[S_{t=12}/S_{t=0}]\times100$$

wherein $S_{t=12}$ stands for the sensitivity of the sample using the coating solution having undergone 12 hours' standing after the preparation and $S_{t=0}$ stands for the sensitivity of the sample using the just prepared coating solution.

TABLE 2

| Sample No. | Emulsion | Hydrazine Derivative Kind | Hydrazine Derivative Amount added (mol/mol Ag) | Surface Active Compound | Photographic Properties Gamma | Photographic Properties ΔS |
|---|---|---|---|---|---|---|
| 2-1 | A | I-38 | $5\times10^{-4}$ | W-1 | 20 | −0.07 |
| 2-2 | A | I-38 | $1\times10^{-4}$ | W-1 | 9 | −0.03 |
| 2-3 | B | I-38 | " | W-1 | 21 | −0.35 |
| 2-4 | B | I-38 | " | W-2 | 20 | −0.28 |
| 2-5 | B | I-38 | " | W-3 | 20 | −0.06 |
| 2-6 | B | I-38 | " | PW-5 | 23 | −0.03 |
| 2-7 | B | I-38 | " | PW-6 | 22 | −0.03 |
| 2-8 | B | I-38 | " | PW-16 | 20 | −0.04 |
| 2-9 | B | I-38 | " | PW-19 | 21 | −0.04 |
| 2-10 | B | I-4 | " | PW-5 | 17 | −0.03 |
| 2-11 | B | I-30 | " | PW-5 | 18 | −0.03 |
| 2-12 | B | I-31 | " | PW-5 | 18 | −0.03 |
| 2-13 | B | I-36 | " | PW-5 | 22 | −0.03 |
| 2-14 | B | I-40 | " | PW-5 | 19 | −0.04 |
| 2-15 | B | I-46 | " | PW-5 | 19 | −0.04 |

As is apparent from the results shown in Table 2, the use of a small amount of hydrazine compound in the presence of a selenium sensitizer brought about very high contrast but was attended by considerable sensitization due to standing of the coating composition in a dissolved condition, and so it failed in ensuring consistent production. However, the sensitization described above was suppressed by using the present surface active compounds. In accordance with an embodiment of the present invention, therefore, it becomes possible to consistently produce photographic materials which are suitable for an He-Ne laser scanner and can exhibit high contrast photographic characteristics even when the amount of a hydrazine derivative used, which is originally small, is further reduced and the materials are processed with a developer having a pH value lower than 11.

EXAMPLE 3

Production of Silver Halide Photographic Materials

Samples were prepared in the same manner as in Example 2, except that the sensitizing dye used in the EM layer was replaced by Compound (S-4) illustrated below.

Compound (S-4)

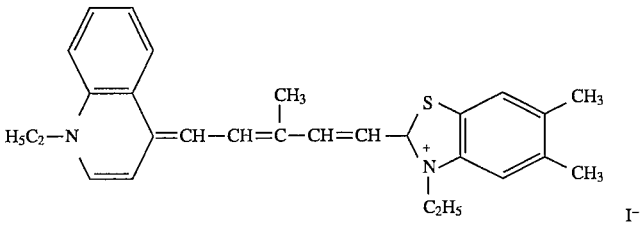

Evaluation of Photographic Properties

Each of the foregoing samples was exposed to a xenon flash lamp (light emitting time: $10^{-6}$ sec.) through both a step wedge and an interference filter having its peak at 780 nm, and then developed for 30 seconds at 35° C. with Developer A described in Example 1. Thereafter, it was subjected successively to fixation (the same as in Example 1), washing and drying operations.

The evaluation of image contrast and the stability test of coating compositions standing in a dissolved condition were made similarly to those in Example 2.

Results

Likewise in Example 2, the sensitization caused by leaving the coating composition dissolved was suppressed by adding the present surface active compounds. In accordance with an embodiment of the present invention, therefore, it becomes possible to consistently produce photographic materials which are suitable for a semiconductor laser scanner and can exhibit high contrast photographic characteristics even when the materials are processed with a developer having a pH value lower than 11.

EXAMPLE 4

Production of Silver Halide Photographic Materials

Samples were prepared in the same manner as in Example 2, except that the sensitizing dye used in the EM layer was replaced by Compound (S-5) illustrated below.

Compound (S-5)

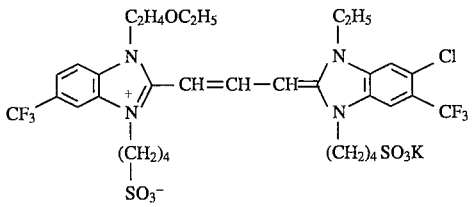

Evaluation of Photographic Properties

Each of the foregoing samples was exposed to tungsten light of 3200° K through a step wedge, and then developed for 30 seconds at 35° C. with Developer A described in Example 1. Thereafter, it was subjected successively to fixation, washing and drying operations. Therein, GR-F1 (trade name, a fixer produced by Fuji Photo Film Co., Ltd.) was used as fixer.

The evaluation of image contrast and the stability test of coating compositions standing in a dissolved condition were made similarly to those in Example 2.

Results

Likewise in Example 2, the sensitization caused by leaving the coating composition dissolved was suppressed by adding the present surface active compounds. In accordance with an embodiment of the present invention, therefore, it becomes possible to consistently produce photographic materials for photographing use which can exhibit high contrast photographic characteristics even when the materials are processed with a developer having a pH value lower than 11.

EXAMPLE 5

Samples were prepared according to the formula described in Example 5 of Japanese Patent Application No. 5- 202547. Therein, however, the present hydrazine compounds and the present surface active compounds were further incorporated. The thus modified samples took the test for the stability of coating compositions in a dissolved condition.

Likewise in Examples from 2 to 4, the sensitization caused by leaving the coating compositions dissolved was suppressed by adding the present surface active compounds.

EXAMPLE 6

Production of Silver Halide Photographic Materials

Samples were prepared in the same manner as in Example 1.

Evaluation of Photographic Properties

The evaluation was made by the same procedure as in Example 1, except that Developer B having the following composition was used in place of Developer A used in Example 1:

| Developer B | |
|---|---|
| Sodium hydroxide | 10.0 g |
| Diethylenetriaminepentaacetic acid | 1.5 g |
| Potassium carbonate | 15.0 g |
| Potassium bromide | 3.0 g |
| 5-Methylbenzotriazole | 0.10 g |
| 1-Phenyl-5-mercaptotetrazole | 0.02 g |
| Potassium sulfite | 10.0 g |
| Sodium 2-mercaptobenzimidazole-5-sulfonate | 0.15 g |
| 4-Hydroxymethyl-4-methyl-1-phenyl-3-pyrazolidone | 0.40 g |
| Sodium erysorbate | 30.0 g |
| Water to make | 1 l |

The pH was adjusted to 10.7 by adding potassium hydroxide.

The evaluation of image contrast and dot quality (DQ), and the stability test of coating compositions standing in a dissolved condition were made similarly to those in Example 1.

Results

Likewise in Example 1, the present surface active compounds were successful in not only inhibiting the hydrazine derivatives from decomposing but also preventing the characteristic curve from showing soft gradation.

EXAMPLE 7

Production of Silver Halide Photographic Materials

Preparation of Emulsion C

Emulsion C was prepared in the following manner: An aqueous solution of silver nitrate and an aqueous solution of sodium chloride were added to an aqueous gelatin solution kept at 40° C. in the presence of $5.0\times10^{-6}$ mol/mol silver of $NH_4RhCl_6$ in accordance with a double jet method. After the water-soluble salt was removed from the emulsion using a method well-known to one skilled in the art, the resulting emulsion was admixed with gelatin, and further with 2-methyl-4-hydroxy- 1,3,3a,7-tetrazaindene as a stabilizer without undergoing any chemical ripening. The thus obtained emulsion was a monodisperse emulsion comprising cubic grains having an average grain size of 0.2 μm.

Preparation of Emulsion-Coated Samples

To this emulsion were added $1.2\times10^{-3}$ moil/mol silver of a hydrazine derivative according to the present invention and $5\times10^{-4}$ mol/mol silver of a surface active compound according to the present invention or for comparative use, as shown in Table 3, and further $1\times10^{-3}$ mol/mol silver of a nucleation accelerator (Compound (A-2) illustrated below).

Compound (A-2)

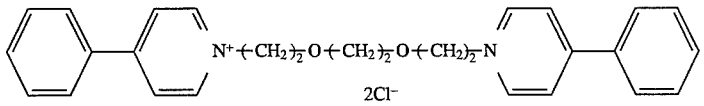

Furthermore, the resulting emulsion was admixed with a polyethylacrylate latex in a proportion of 30% by weight, on a solid basis, to gelatin, and 1,3-divinylsulfonyl-2-propanol as a hardener. The thus obtained emulsion was coated on a polyester support at 3.8 g/m² in terms of silver. Gelatin was coated in an amount of 1.8 g/m². On this coating was formed a protective layer containing 1.5 g/m² of gelatin and 0.3 g/m² of polymethylmethacrylate having a particle size of 2.5 μm.

The polyester support used above had backing and back-protecting layers having the following compositions respectively. The swelling degree on the back side of the support was 110%.

| [Backing Layer] | |
|---|---|
| Gelatin | 170 mg/m² |
| Sodium dodecylbenzenesulfonate | 32 mg/m² |
| Sodium dihexyl-α-sulfosuccinate | 35 g/m² |
| $SnO_2$/Sb (ratio: 90/10 by weight, average grain size: 0.25 μm) | 318 mg/m² |

| [Back Protecting Layer] | |
|---|---|
| Gelatin | 2.7 g/m² |
| Silicon dioxide matting agent (average grain size: 3.5 μm) | 26 mg/m² |
| Sodium dihexyl-α-sulfosuccinate | 20 mg/m² |
| Sodium dodecylbenzenesulfonate | 67 mg/m² |
| $C_8F_{17}SO_2N(C_3H_7)-(CH_2CH_2O)_n-(CH_2)_4-SO_3Li$ | 5 mg/m² |
| Dye A 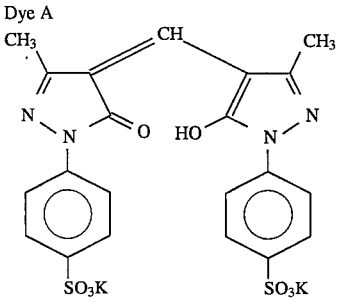 | 190 mg/m² |
| Dye B 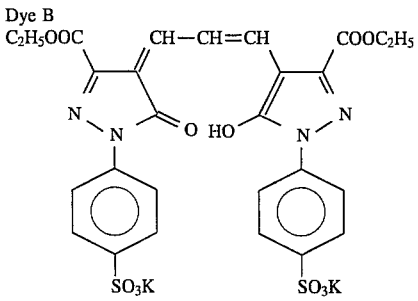 | 32 mg/m² |

-continued

| [Back Protecting Layer] | |
|---|---|
| Dye C 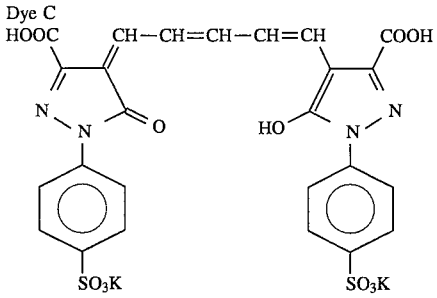 | 59 mg/m² |
| Ethylacrylate latex (average particle size: 0.05 μm) | 260 mg/m² |
| 1,3-Divinylsulfonyl-2-propanol | 149 mg/m² |

Evaluation of Photographic Properties

TABLE 3

| | Formula | | Photographic Properties | | Remaining | |
|---|---|---|---|---|---|---|
| Sample No. | Hydrazine Derivative | Surface Active Compound | Coating Just After Preparation Gamma | Coating After 12 Hours' Standing Gamma | Rate (%) of Hydrazine Derivative | Note |
| 3-1 | I-33 | — | 24 | 12 | 33 | Comparison |
| 3-2 | I-33 | W-1 | 25 | 13 | 38 | Comparison |
| 3-3 | I-33 | W-2 | 24 | 13 | 35 | Comparison |
| 3-4 | I-33 | W-3 | 26 | 15 | 49 | Comparison |
| 3-5 | I-33 | PW-5 | 27 | 27 | 93 | Invention |
| 3-6 | I-33 | PW-6 | 26 | 25 | 91 | Invention |
| 3-7 | I-33 | PW-16 | 25 | 24 | 92 | Invention |
| 3-8 | I-33 | PW-19 | 26 | 26 | 91 | Invention |
| 3-9 | I-43 | PW-5 | 26 | 25 | 92 | Invention |
| 3-10 | I-45 | PW-5 | 25 | 25 | 90 | Invention |
| 3-11 | I-49 | PW-5 | 26 | 26 | 91 | Invention |
| 3-12 | I-52 | PW-5 | 29 | 28 | 92 | Invention |

(1) Exposure and Photographic Processing:

Each of the samples obtained was exposed via a step wedge by means of a daylight printer P-627 FM, produced by Dai-Nippon Screen Mfg. Co., Ltd., and then processed with an automatic developing machine, FG10NH, produced by Fuji Photo Film Co., Ltd., wherein development was carried out for 20 seconds at 38° C. with Developer A described in Example 1 and the fixation was carried out with the same fixer as used in Example 1, followed by washing and drying operations.

(2) Evaluation of Image Contrast:

Evaluation was made by the same procedure as in Example 1.

(3) Stability Test of Coating Composition Standing in Dissolved Condition

In order to examine the influence of a hydrazine derivative upon the stability of each coating composition standing in a dissolved condition (abbreviated as "coating solution") for coating the emulsion layer, two kinds of samples were prepared in the same manner, except that in coating the EM layer the coating solution which had just been prepared was used for one sample but the coating solution which had undergone 12 hours' standing after the preparation was used for the other sample. These samples were each examined for gamma, and a change in this characteristic between them was determined. Further, likewise in Example 1, the hydrazine derivative content in each coating solution was determined by HPLC (high-speed liquid chromatography) just after the preparation and after 12 hours' standing respectively, and therefrom were calculated the remaining rates of the hydrazine derivatives.

As is apparent from the results shown in Table 3, the present surface active compounds were successful in not only inhibiting the hydrazine derivatives from decomposing but also preventing the characteristic curves from showing soft gradation. In accordance with an embodiment of the present invention, therefore, it becomes possible to consistently produce daylight photographic materials for reversing use which can exhibit high contrast photographic characteristics even when they are processed with a developer whose pH is lower than 11.

While the invention has been described in detail and with reference to specific embodiments thereof, it will be apparent to one skilled in the art that various changes and modifications can be made therein without departing from the spirit and scope thereof.

What is claimed is:

1. A silver halide photographic material comprising a hydrazine derivative represented by the following formula (I) and a surface active compound represented by the following formula (II):

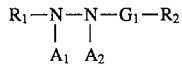

$$R_1-\underset{\underset{A_1}{|}}{N}-\underset{\underset{A_2}{|}}{N}-G_1-R_2 \quad (I)$$

wherein $R_1$ represents an aliphatic group or an aromatic group;

$R_2$ represents a hydrogen atom, an alkyl group, an aryl group, an unsaturated heterocyclic group, an alkoxy group, an aryloxy group, an amino group or a hydrazino group;

$G_1$ represents —CO—, —$SO_2$—, —SO—, —PO($R_3$)— or —CO—CO—, a thiocarbonyl group or an iminomethylene group, in which $R_3$ has the same meaning as $R_2$;

$A_1$ and $A_2$ are both a hydrogen atom, or one of them is a hydrogen atom and the other is an alkylsulfonyl group, an arylsulfonyl group, or an acyl group;

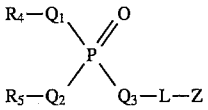

(II)

wherein $R_4$ represents an aliphatic group, an alicyclic group, an aromatic group or a heterocyclic group;

$R_5$ represents an aliphatic group, an alicyclic group, an aromatic group, a heterocyclic group or a group represented by —L—Z in which L represents a divalent linkage group; and Z represents an ionic group; and $Q_1$, $Q_2$ and $Q_3$ each represents a single bond, an oxygen atom, a sulfur atom or a group represented by —N($R_6$)— or —N($R_6$)—CO—, in which $R_6$ represents a hydrogen atom or has the same meaning as $R_5$;

with the proviso that, when $R_5$ represents a group represented by —L—Z, the $R_5$ and the —L—Z which is directly bonded to $Q_3$ are the same or different;

two or more of $R_4$, $R_5$ and L may be combined with each other to from a ring; and the surface active compound may be represented by combining two or more of formulae (II) via $R_4$, $R_5$ and L.

2. The silver halide photographic material as claimed in claim 1, which comprises a support having thereon at least one silver halide emulsion layer containing the hydrazine derivative represented by formula (I) and the surface active compound represented by formula (II).

3. The silver halide photographic material as claimed in claim 2, wherein the silver halide emulsion layer comprises a silver halide emulsion chemically sensitized with a selenium sensitizer of at least $1\times10^{-8}$ mol per mol of silver.

4. The silver halide photographic material as claimed in claim 1, wherein the aliphatic group or the aromatic group represented by $R_1$, or the alkyl group, the aryl group, the unsaturated heterocyclic group, the alkoxy group, the aryloxy group, the amino group or the hydrazino group represented by $R_2$ is substituted by one or more substituents selected from the group consisting of an alkyl group, an alkenyl group, an alkynyl group, an aryl group, a group containing a heterocyclic ring, a pyridinium group, a hydroxyl group, an alkoxy group, an aryloxy group, an acyloxy group, an alkylsulfonyloxy group, an arylsulfonyloxy group, an amino group, a carbonamido group, a sulfonamido group, a ureido group, a thioureido group, a semicarbazido group, a thiosemicarbazido group, a urethane group, a group having a hydrazide structure, a group having a quaternary ammonium structure, an alkylthio group, an arylthio group, an alkylsulfonyl group, an arylsulfonyl group, an alkylsulfinyl group, an arylsulfinyl group, a carboxyl group, a sulfo group, an acyl group, an alkoxycarbonyl group, an aryloxycarbonyl group, a carbamoyl group, a sulfamoyl group, a halogen atom, a cyano group, a phosphonamido group, a diacylamino group, an imido group, a group having an acylurea structure, a group containing a selenium atom or a tellurium atom, and a group having a tertiary sulfonium structure or a quaternary sulfonium structure, which each may be further substututed by one or more of said substituents.

5. The silver halide photographic material as claimed in claim 1, wherein the aliphatic group, the alicyclic group, the aromatic group or the heterocyclic group represented by $R_4$ or $R_5$ is substituted by one or more substituents selected from the group consisting of an alkoxy group, an aryl group, a halogen atom, a carbon ester group, a carbonamido group, a carbamoyl group, an oxycarbonyl group, a phosphoric acid ester group, an alkyl group, an alkenyl group and an alkynyl group, which each may be further substituted by one or more of said substituents.

6. A process for forming a photographic image, which comprises the steps of (a) imagewise exposing a silver halide photographic material comprising a hydrazine derivative represented by the following formula (I) and a surface active compound represented by the following formula (II):

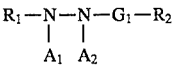

(I)

wherein $R_1$ represents an aliphatic group or an aromatic group;

$R_2$ represents a hydrogen atom, an alkyl group, an aryl group, an unsaturated heterocyclic group, an alkoxy group, an aryloxy group, an amino group or a hydrazino group;

$G_1$ represents —CO—, —$SO_2$—, —SO—, —PO($R_3$)— or —CO—CO—, a thiocarbonyl group or an iminomethylene group, in which $R_3$ has the same meaning as $R_2$;

$A_1$ and $A_2$ are both a hydrogen atom, or one of them is a hydrogen atom and the other is an alkylsulfonyl group, an arylsulfonyl group, or an acyl group;

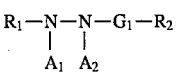

(I)

wherein $R_4$ represents an aliphatic group, an alicyclic group, an aromatic group or a heterocyclic group;

$R_5$ represents an aliphatic group, an alicyclic group, an aromatic group, a heterocyclic group or a group represented by —L—Z in which L represents a divalent linkage group; and Z represents an ionic group; and $Q_1$, $Q_2$ and $Q_3$ each represents a single bond, an oxygen atom, a sulfur atom or a group represented by —N($R_6$)— or —N($R_6$)—CO—, in which $R_6$ represents a hydrogen atom or has the same meaning as $R_5$;

with the proviso that, when $R_5$ represents a group represented by —L—Z, the $R_5$ and the —L—Z which is directly bonded to $Q_3$ are the same or different;

two or more of $R_4$, $R_5$ and L may be combined with each other to from a ring; and the surface active compound may be represented by combining two more or of formulae (II) via $R_4$, $R_5$ and L; and (b) developing the exposed material with a developer having a pH of from 9.0 to less than 11.0.

7. The process as claimed in claim 6, wherein the silver halide photographic material comprises a support having thereon at least one silver halide emulsion layer containing the hydrazine derivative represented by formula (I) and the surface active compound represented by formula (II).

8. The process as claimed in claim 7, wherein the silver halide emulsion layer comprises a silver halide emulsion chemically sensitized with a selenium sensitizer of at least $1\times10^{-8}$ mol per mol of silver.

* * * * *